US011033798B2

(12) United States Patent
Svendsen et al.

(10) Patent No.: US 11,033,798 B2
(45) Date of Patent: Jun. 15, 2021

(54) MOUNTING PLATE WITH RAIL FOR A BINDING

(71) Applicant: ROTTEFELLA AS, Klokkarstua (NO)

(72) Inventors: Oyvar Svendsen, Oslo (NO); Steinar Holos, Oslo (NO); Jorn Frode Danielsen, Drobak (NO); Thomas Goverud-Holm, Hoff (NO)

(73) Assignee: ROTTEFELLA AS, Klokkarstua (NO)

( * ) Notice: Subject to any disclaimer, the term of this patent is extended or adjusted under 35 U.S.C. 154(b) by 0 days.

(21) Appl. No.: 16/483,609

(22) PCT Filed: Feb. 2, 2018

(86) PCT No.: PCT/NO2018/050029
§ 371 (c)(1),
(2) Date: Aug. 5, 2019

(87) PCT Pub. No.: WO2018/143822
PCT Pub. Date: Aug. 9, 2018

(65) Prior Publication Data

US 2020/0094126 A1 Mar. 26, 2020

(30) Foreign Application Priority Data

Feb. 3, 2017 (NO) ..... 20170170

(51) Int. Cl.
*A63C 9/20* (2012.01)
*A63C 9/086* (2012.01)
*A63C 9/00* (2012.01)

(52) U.S. Cl.
CPC ..... *A63C 9/086* (2013.01); *A63C 9/003* (2013.01); *A63C 9/005* (2013.01); *A63C 9/0053* (2019.05); *A63C 9/20* (2013.01); *A63C 2009/008* (2013.01)

(58) Field of Classification Search
CPC .... A63C 9/00; A63C 9/0053; A63C 2009/008
See application file for complete search history.

(56) References Cited

U.S. PATENT DOCUMENTS 4,436,322 A 3/1984 Wittmann et al.
6,659,494 B1 * 12/2003 Martin ..... A63C 9/0802 280/612

(Continued)

FOREIGN PATENT DOCUMENTS

CN 103189111 A 7/2013
DE 102010048963 A1 4/2012

(Continued)

OTHER PUBLICATIONS

International Search Report PCT/ISA/210 for International Application No. PCT/NO2018/050029 dated Jun. 6, 2018.

(Continued)

*Primary Examiner* — Brian L Swenson
(74) *Attorney, Agent, or Firm* — Harness, Dickey & Pierce, P.L.C.

(57) ABSTRACT

A mounting system for a binding or a binding component on a cross-country ski includes a mounting plate that is arranged on the top surface of the cross-country ski. The mounting plate comprises longitudinal side edges having a profile with undercuts for longitudinal positioning and attachment of the binding or binding component with the aid of a complementary profile on the binding or binding component. The mounting plate comprises a longitudinal channel that houses a longitudinal rail. The upper side of the longitudinal rail comprises at least one locking device. The underside of the binding or binding component comprises at least one complementary locking device.

10 Claims, 26 Drawing Sheets

(56) References Cited

U.S. PATENT DOCUMENTS

| | | | | |
|---|---|---|---|---|
| 6,779,810 | B1 * | 8/2004 | Mangold | A63C 5/128 280/11.32 |
| 7,448,641 | B2 * | 11/2008 | Buquet | A63C 9/005 280/607 |
| 8,662,524 | B2 * | 3/2014 | Girard | A63C 9/003 280/607 |
| 9,033,359 | B2 * | 5/2015 | Favret | A63C 5/07 280/613 |
| 2005/0116444 | A1 * | 6/2005 | Himmetsberger | A63C 9/005 280/617 |
| 2005/0167950 | A1 * | 8/2005 | Martin | A63C 9/0885 280/618 |
| 2007/0273127 | A1 * | 11/2007 | Girard | A63C 9/003 280/607 |
| 2008/0047168 | A1 | 2/2008 | Svensson | |
| 2008/0197607 | A1 * | 8/2008 | Merino | A63C 9/0802 280/617 |
| 2008/0203703 | A1 | 8/2008 | Hauglin et al. | |
| 2013/0270797 | A1 * | 10/2013 | Bjertnaes | A63C 9/005 280/611 |
| 2014/0001733 | A1 * | 1/2014 | Bennert | A63C 9/086 280/613 |
| 2014/0131980 | A1 | 5/2014 | Girard et al. | |
| 2017/0080325 | A1 * | 3/2017 | Barden | A63C 9/0805 |
| 2018/0264348 | A1 * | 9/2018 | Pantazelos | A63C 7/102 |

FOREIGN PATENT DOCUMENTS

| | | | |
|---|---|---|---|
| EP | 1839713 | A1 | 10/2007 |
| EP | 2656884 | A1 | 10/2013 |
| EP | 2090338 | B1 | 12/2013 |
| EP | 1958678 | B1 | 6/2016 |
| NO | 327573 | B1 | 8/2009 |
| NO | 335244 | B1 | 10/2014 |
| NO | 20130873 | A1 | 12/2014 |
| NO | 20150320 | A1 | 9/2016 |
| NO | 340839 | B1 | 6/2017 |
| WO | WO-9858710 | A1 | 12/1998 |
| WO | WO-2012/045329 | A1 | 4/2012 |
| WO | WO-2012/045723 | A1 | 4/2012 |
| WO | WO-2016197256 | A1 | 12/2016 |

OTHER PUBLICATIONS

Written Opinion of the International Searching Authority PCT/ISA/237 for International Application No. PCT/NO2018/050029 dated Jun. 6, 2018.

Norwegian Search Report for Norwegian Patent Application No. 20170170 dated Aug. 7, 2017.

English-language translation of Chinese Office Action and Search Report dated Dec. 23, 2020 for corresponding Chinese Application No. 201880016251.5.

* cited by examiner

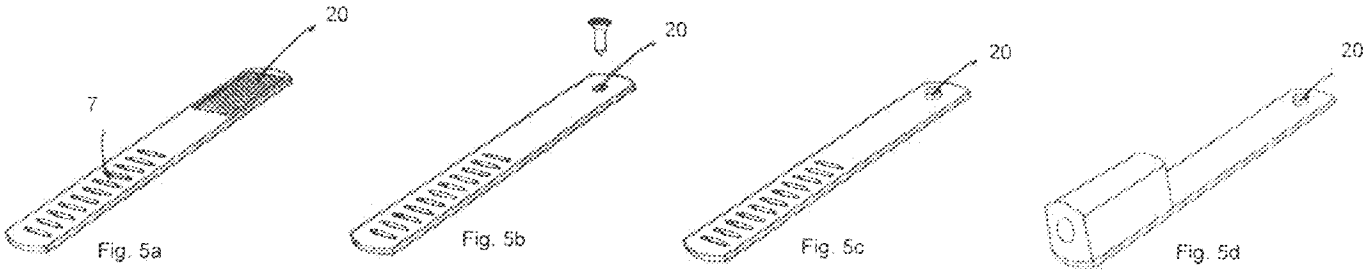
Fig. 5a
Fig. 5b
Fig. 5c
Fig. 5d
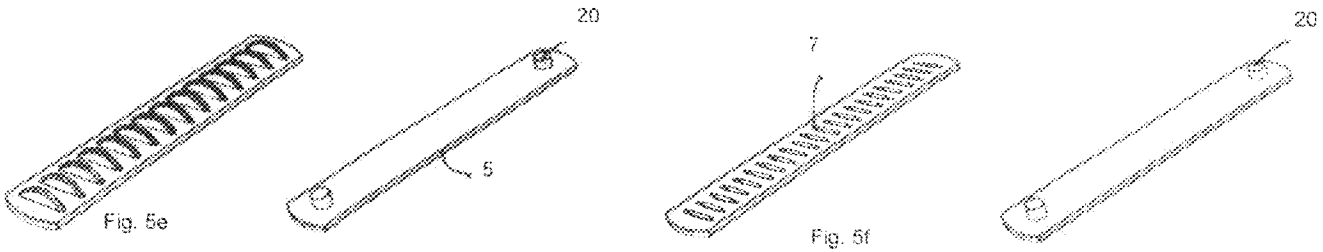
Fig. 5e
Fig. 5f 21
33
5
22
23
2
3
34

23
23
23
24
25
6

5
7

6

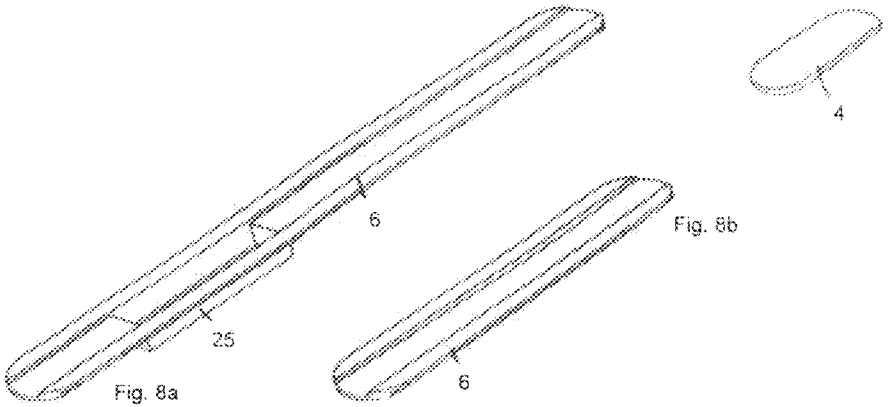
Fig. 8a
Fig. 8b
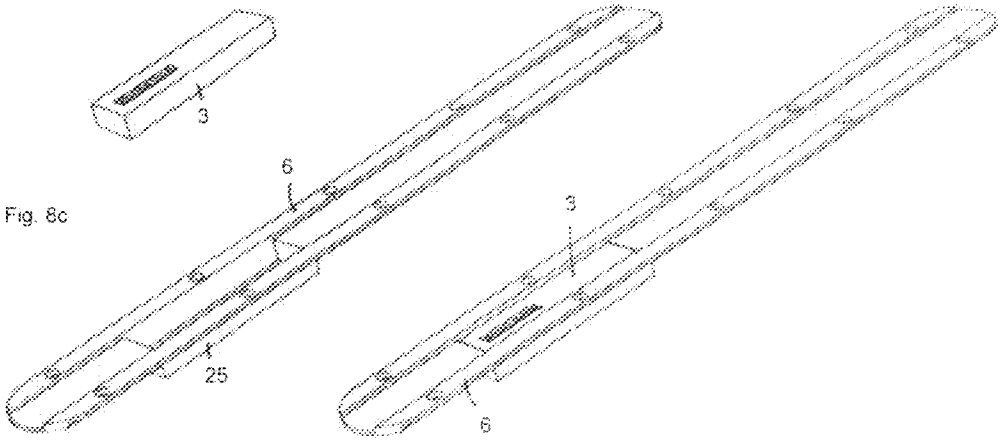
Fig. 8c 1
2
20
21
22
23
24
33
34

MOUNTING PLATE WITH RAIL FOR A BINDING

CROSS-REFERENCE TO RELATED APPLICATIONS

This application is a national phase under 35 U.S.C. § 371 of PCT International Application No. PCT/NO2018/050029 which has an International filing date of Feb. 2, 2018, which claims priority to Norwegian Patent Application No. 20170170, filed Feb. 3, 2017, the entire contents of each of which are hereby incorporated by reference.

The present invention relates to a mounting system for a binding, or parts thereof, on a cross-country ski.

NO335244 and NO327573 relate to a mounting plate for attaching a binding to a ski. The mounting plate is glued onto the top surface of a ski and comprises longitudinal side edges that have a profile with undercuts for longitudinal positioning and attachment of the binding or the binding components with the aid of a complementary profile. The mounting plate has a rigidity that has little impact on the rigidity and properties of the skis. This mounting plate allows a binding to be mounted on a ski without the use of screws, glue and other tools, thereby avoiding puncturing the sealing around the ski core. In addition, the mounting plate is advantageous for dealers because the mounting requires a minimum of qualifications and is fully reversible. For the end user, the mounting plate is advantageous because the ski can to a greater degree be adapted to weight, proficiency and snow/waxing conditions.

NO20150320 relates to an invention that provides completely new possibilities in the sport of skiing. NO20150320 discloses a binding system for optional dynamic longitudinal positioning of a binding on a cross-country ski with the aid of an electric actuator, energy source and a control system. This dynamic system permits, inter alia, a skier to alter the position of the binding whilst in motion, such that in practice a gear system is obtained which makes it easier and faster to move forwards. A dynamic binding system can be mounted on or in a ski with the aid of a mounting plate, but the existing mounting plates are not very suitable.

An object of the invention is to provide a mounting system suitable for a dynamic binding system, where the binding can be moved whilst the skier is in motion.

Another object of the invention is to provide a mounting system which is also suitable for binding systems where the binding is manually movable.

A further object of the invention is to provide a mounting system suitable for a range of binding types, both movable and fixed.

A further object of the invention is to provide a mounting system suitable for a range of binding types from different manufacturers and/or different areas of utilisation.

A further object of the invention is to provide a mounting system that allows a binding system to be supplemented with other and new functionality.

These and other objects are obtained by means of a mounting system according to attached claim 1. Additional advantageous features and embodiments are disclosed in the dependent claims.

A non-limiting description of advantageous embodiments is given below with reference to the drawing figures, wherein:

FIGS. 1*a-c* show an embodiment of a system according to the present invention;

FIGS. 2*a-c* show a second embodiment of a system according to the present invention;

FIGS. 3*a-b* show a third embodiment of a system according to the present invention;

FIGS. 4*a-c* show possible embodiments of plates/rails.

FIGS. 5*a-f* show possible embodiments of rails.

FIGS. 6*a-i* show cross-sections of possible embodiments according to the present invention;

FIGS. 7*a-b* show further possible embodiments of plates/rails according to the present invention.

FIGS. 8*a-c* show alternative embodiments;

FIGS. 9*a-b* show alternative embodiments;

FIGS. 10*a-b* show further alternative embodiments of the present invention;

FIGS. 11*a-e* show a manual embodiment of the present invention;

Figure 18A:
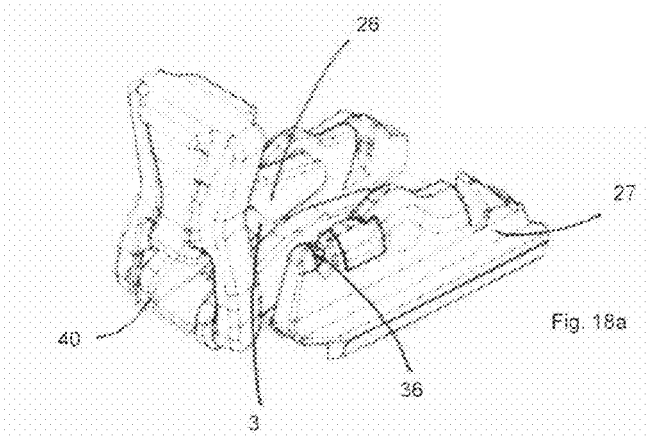
Figure 18B:
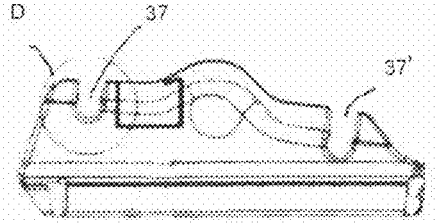
Figure 18C:
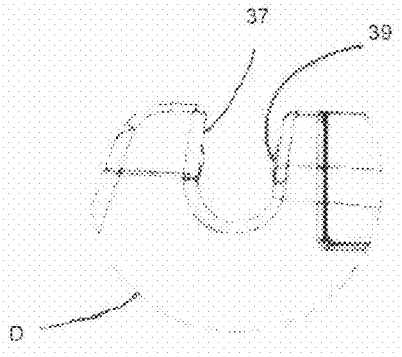

FIGS. 15*a-d* show an alternative embodiment of a rail;

FIGS. 16*a-d* show an alternative embodiment of a rail;

FIGS. 17*a-e* show a manual embodiment of the invention;

FIGS. 18*a-c* show details of the embodiment shown in FIGS. 17*a-e;*

Figure 19:
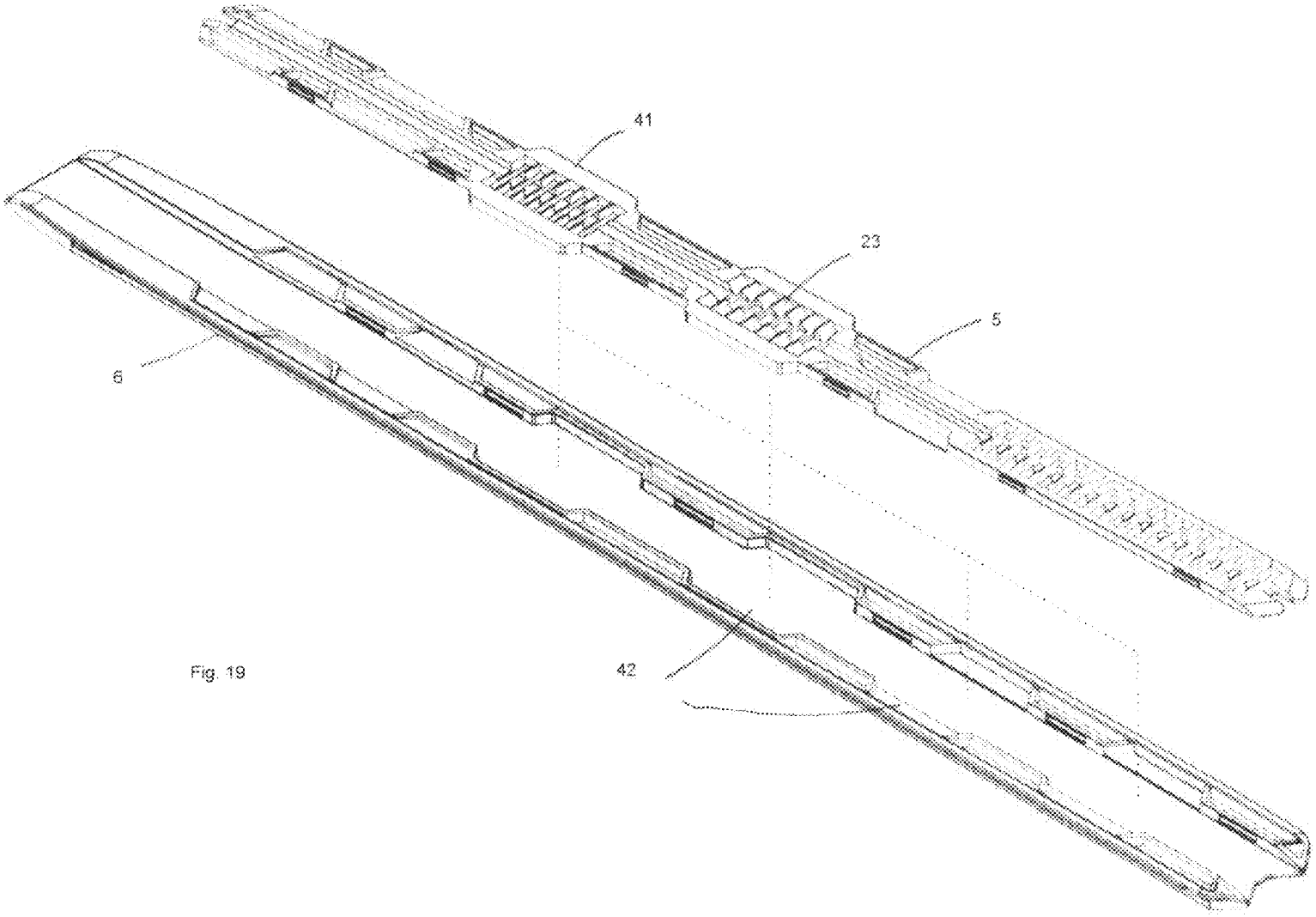

FIG. 19 shows an alternative embodiment of a rail; and

Figure 20A:
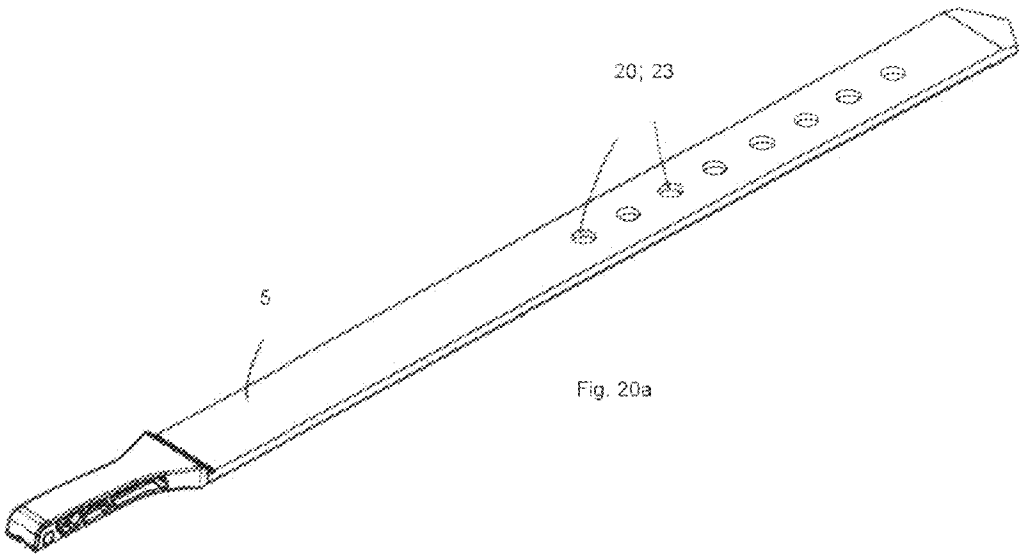
Figure 20B:
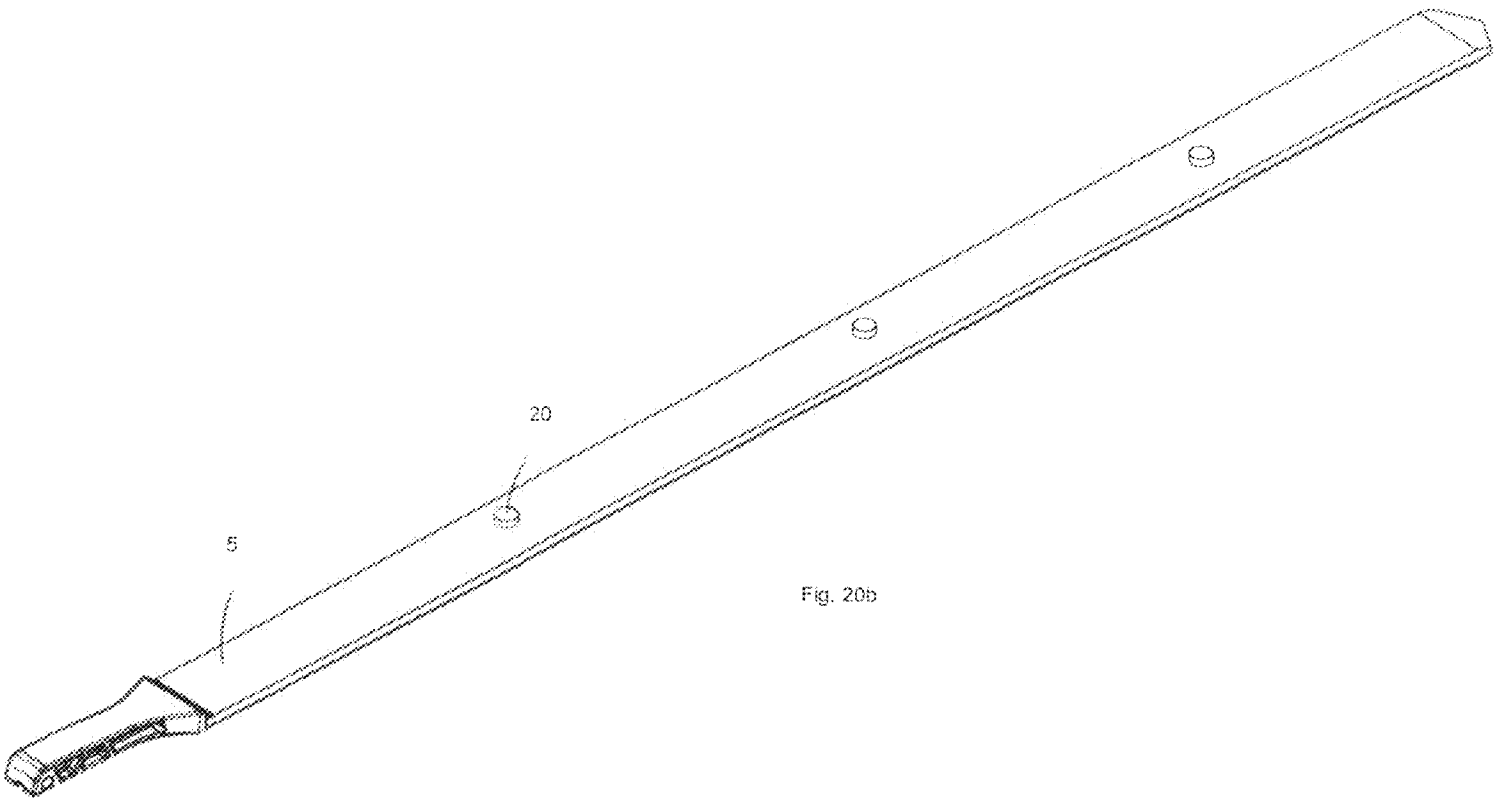
Figure 20C:
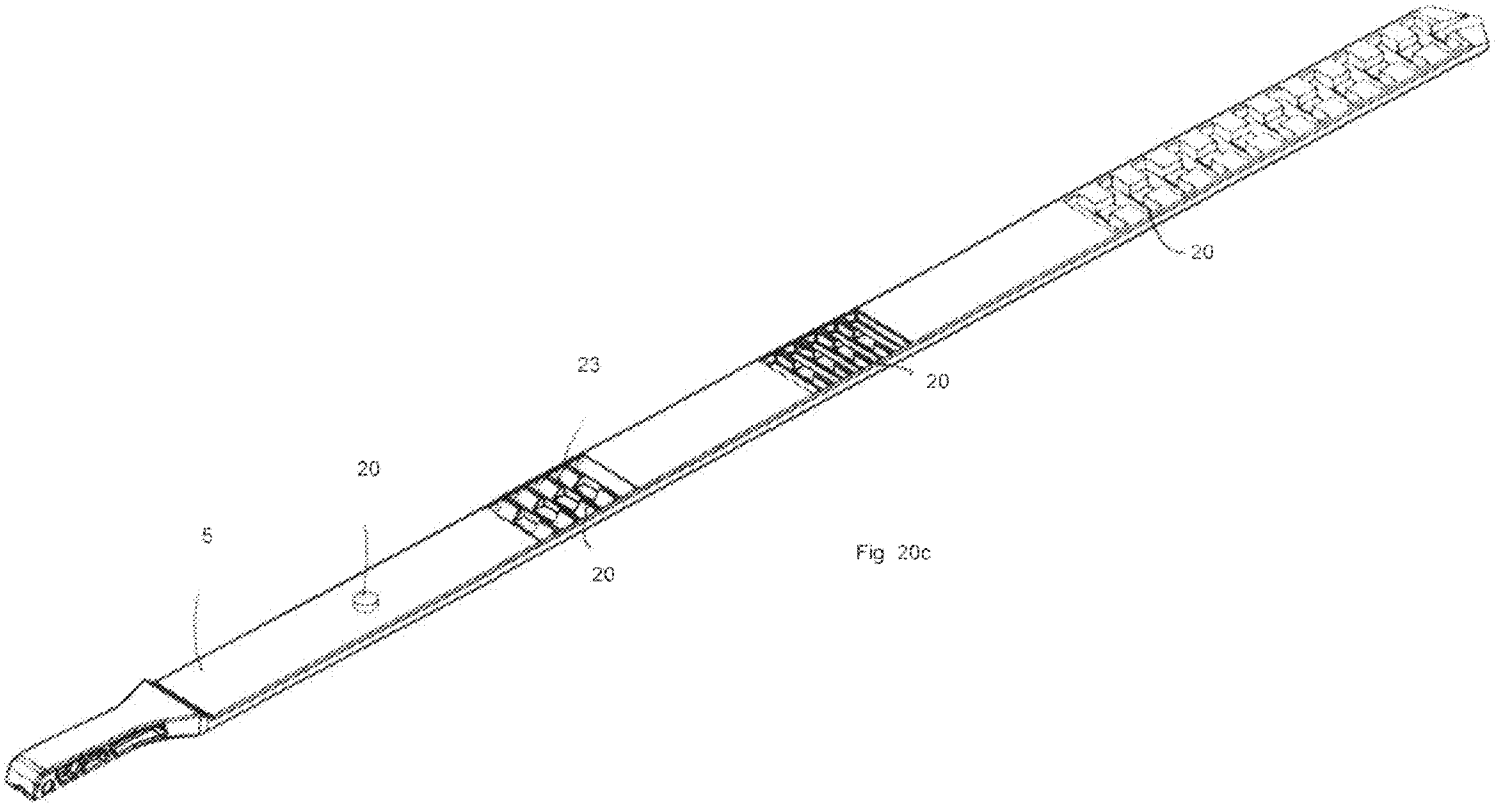

FIGS. 20*a-c* show alternative embodiments of a rail.

Figure 1A:
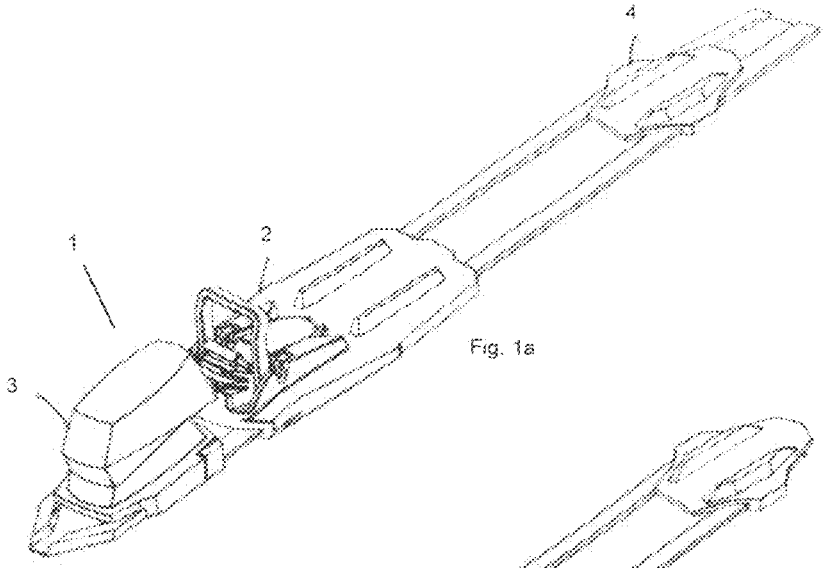
Figure 1B:
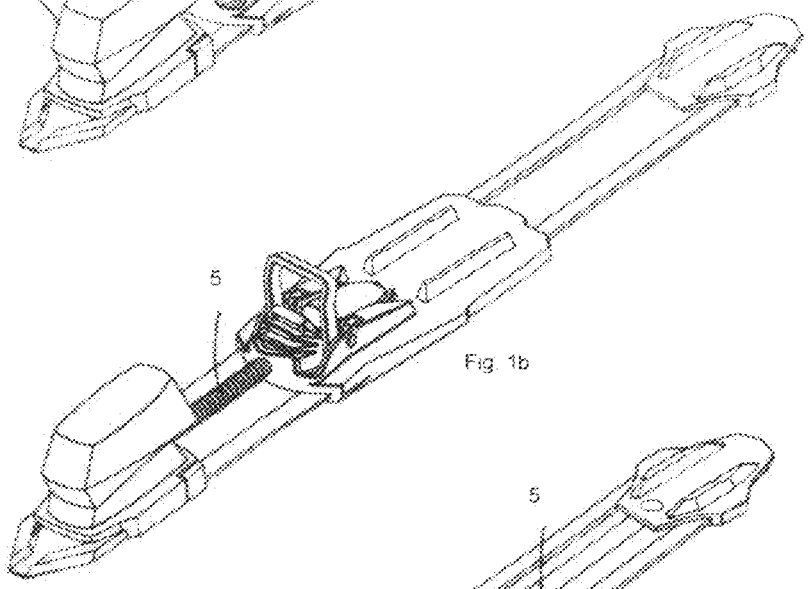
Figure 1C:
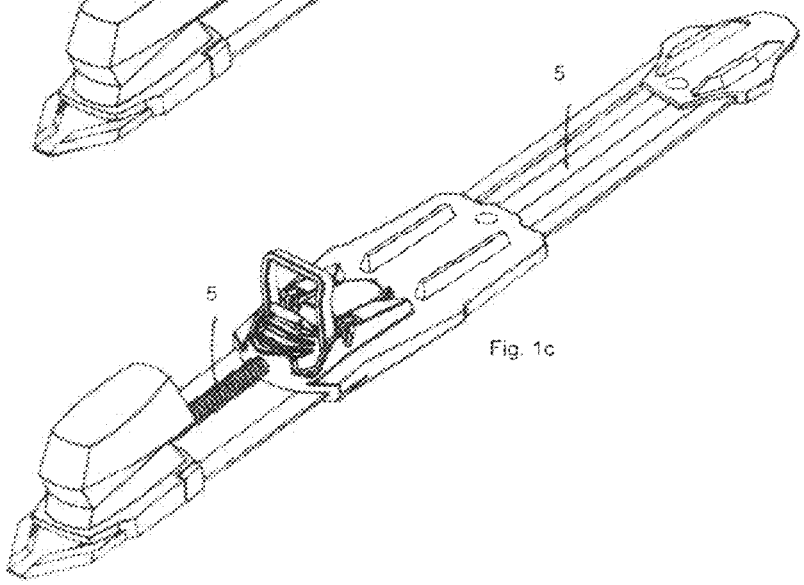

FIGS. 1*a-c* show an embodiment of the present invention comprising an electric and remote-controlled system 1 for changing a skier's position on a ski in the longitudinal direction. An electric motor 3 is arranged such that it pushes a binding 2 on a ski forwards or backwards according to an electrical signal given by a skier. The motor 3 pushes/pulls a binding 2 and a heel piece 4 with the aid of a rail or an energy transfer means 5. The rail 5 is arranged in a channel 21 and is configured such that it can slide back and forth in the longitudinal direction of the ski. The motor 3 and the binding or binding components 2 are mounted on a mounting plate 6. In this embodiment, the binding or binding components 2 and the heel piece 4 are displaceably mounted on the mounting plate 6.

In this document it should be understood that a "rail" and an "energy transfer means" 5 can be designed in different ways and may also comprise a rod, a bar or similar elements, which may have different shapes, cross-sections, widths and length. More than one rail may also be used. If several rails are used, either in series or in parallel, they may conceivably be movable independent of one another, so as thereby to obtain different functions. Materials can be selected according to need. Different examples of rails and energy transfer means are shown in FIGS. 6*a-i* and 10*a-b*.

Figure 2A:
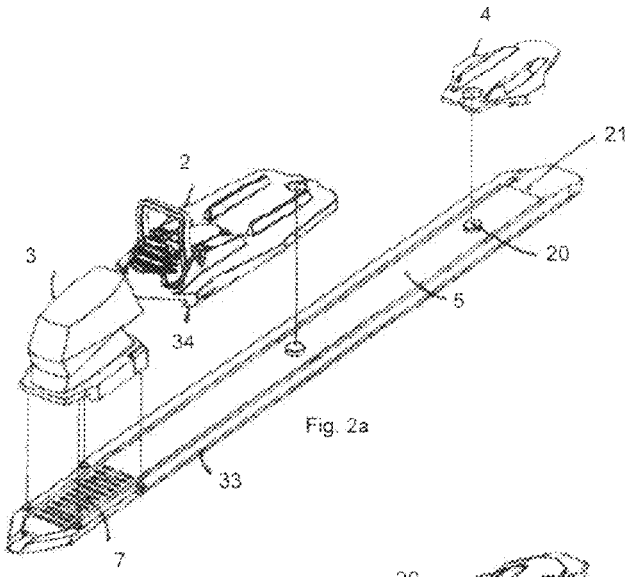
Figure 2B:
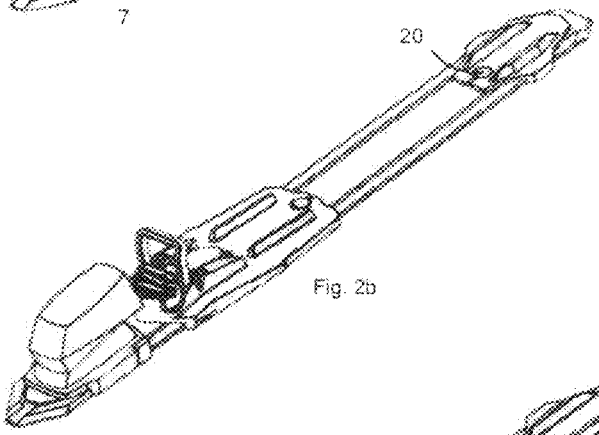
Figure 2C:
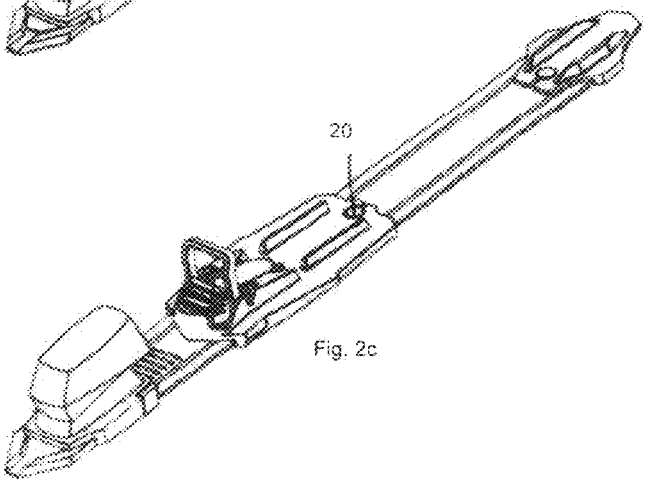
Figures 6A, 6B, 6C, 6D, 6E, 6F, 6G, 6H, 6I:
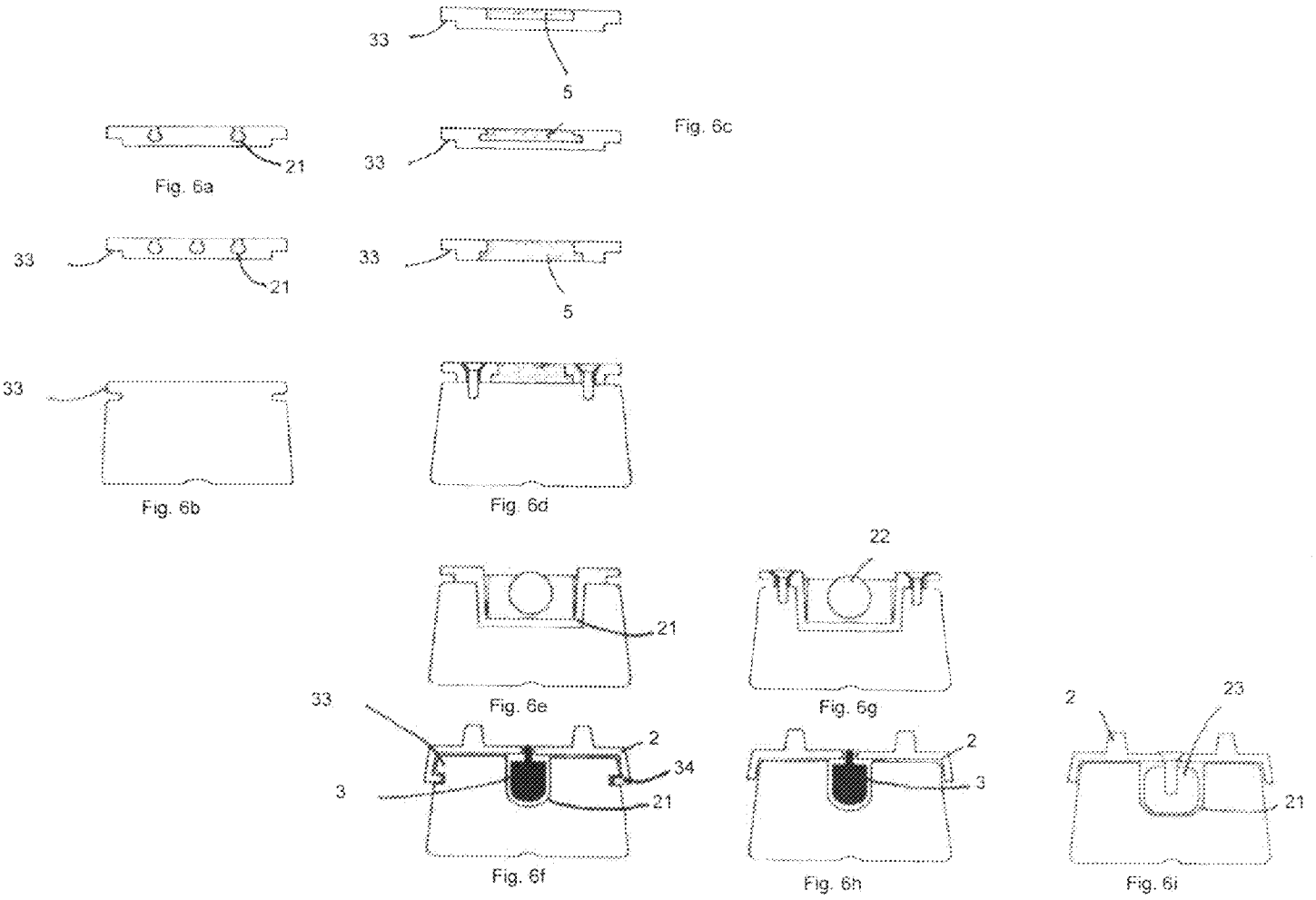

As shown in FIGS. 2*a-c*, a rail 5 can be mounted in a longitudinally extending direction in a channel 21 or the like in or on the mounting plate 6. In the illustrated embodiment, the rail 5 runs in the mounting plate 6, where during mounting it can, e.g., be inserted into the channel 21 from one end or the other of the mounting plate 6 in such a way that the rail 5 is able to move in the longitudinal direction of the plate, whilst being held securely fixed by the plate in all other directions. An embodiment where the rail can be placed straight into a groove in the mounting plate 6 is also conceivable, ref. FIGS. 6*b* and *f* and 10*a-b*. Different embodiments of the rail or the energy transfer means are shown in FIGS. 4*a-c*, 5*a-f*, 6*a-i*, 7*a-b*, 10*a-b*, 11*a-e*, 15*a-d* and 16*a-d*. In the embodiments shown in, e.g., FIGS. 4*a-c* and 6*a, c* and *d*, the mounting plate 6 has undercuts in the channel 21 that cooperate with a matching profile along the longitudinal sides of the rail 5. Other embodiments are also conceivable, e.g., that the rail 5 runs in an at least partly closed channel, either in the mounting plate 6 or in a ski (e.g., 6*e-i*, 10*a-b*). It will be appreciated that that the mounting plate 6 can be mounted on the ski either with the aid of screws, glue or bonding, ref., e.g., 6*d* and 10*a-b*. The mounting plate 6 may also be an integral part of a ski (e.g., FIGS. 6*b* and 6*f*). In the last-mentioned case, it could be said that the ski constitutes the mounting plate and that the ski comprises undercuts and a channel 21, thereby comprising the same functions and elements as an individual mounting plate 6 that is arranged on a ski.

In FIG. 2*a* it is seen that a motor 3 can be mounted on a forward part of the mounting plate 6 in such a way that the motor 3 is fixed in relation to the mounting plate 6 and the ski. Although the motor 3 is shown mounted in front of the binding or binding components 2 and on top of the mounting plate 6, the motor 5 can optionally be mounted behind the binding or binding components 2 and/or the heel piece 4, under the binding or binding components 2 or the mounting plate 6, under the binding or binding components 2 or the mounting plate 6 integrated in the ski or even in a ski shoe (not shown). FIG. 2*a* further shows the rail 5 that is mounted extending longitudinally in a channel 21 in the mounting plate 6. The binding or binding components 2 and the heel piece 4 are mounted in or on this rail 5, in this case with the aid of a pin or pins 20 on the rail 5 that can be snapped or in some other way inserted into complementary holes or grooves in the binding or binding components 2, optionally vice versa. FIGS. 1*b-c* show the embodiment assembled, in the forward and rear position, respectively.

An important aspect of the invention shown in FIGS. 2*a-c* is that the mounting plate 6, the rail 5 and the binding or binding components 2 form a three-part unit, the binding or binding components 2 forming a lock that holds the three-part unit together, whilst the rail 5 and the binding or binding components 2 are allowed to slide in the channel 21 in the longitudinal direction. In this embodiment, the binding or binding components 2 are locked to the rail in the longitudinal direction whilst the binding or binding components 2 grip around the mounting plate 3 and the rail 5 such that the three parts form an interconnected three-part unit.

The rail 5 may be provided with grooves, pins or notches 7 that are suited to engaging with a toothed wheel (not shown) or the like in or from the motor. Glue, hook-and-loop fasteners, bonding etc. may also be used. The grooves or notches 7 may have different configuration or location depending on the configuration and location of the motor 3. Examples of grooves, pins or notches 7 are, e.g., shown in FIGS. 5*a-c*. The grooves, pins and/or the notches 7 can also be arranged on the underside of the rail, such that they engage with a motor 3 that is arranged in the ski on the underside of the rail, ref. FIGS. 5*e-f* and 8*c*. Possible configurations of grooves, ridges, bosses, arms or holes 20 on the upper side of the rail 5 can be seen in FIGS. 5*e-f*. FIG. 5*a* shows an embodiment where a friction surface, hook-and-loop fastener or glue/bonding can be used as a fastening means 20 for engagement with the underside of the binding or binding components 2; 4 comprising at least one complementary locking device. FIGS. 5*a-f* show rails 5 which are relatively short and intended only to extend to the forward part of the binding or binding component 2. It should be understood that the rail can also extend further back under the binding or binding component 2, e.g., rails 5 corresponding to the embodiments shown in FIGS. 4*a-c*, 7*b*, 15*a-d* and 16*a-d*.

FIGS. 1*a-c*, 2*a*-2*c*, 3*a-b*, 4*a-c*, 11*a*-11*e*, 12, 13 and 14 also show a mounting plate 6 comprising a longitudinal channel 21 holding a longitudinal rail 5, the upper side of the rail 5 comprising a plurality of longitudinal grooves 7; 20; 23 that form one part of a locking device. Furthermore, binding components 2 are shown whose underside comprises a plurality of complementary grooves that form the second part of the locking device. The grooves on the rail 5 and the complementary grooves on the binding components are designed to engage with each other. At the same time, the longitudinal side edges of the mounting plate comprise a profile 33 with undercuts and the binding or binding components 2 comprise a complementary profile 34. Several of the figures show that the binding components grip around and are locked to the mounting plate in that the profiles fit into each other. In a number of the illustrated embodiments, the rail 5 and the binding components can be moved in the longitudinal direction when the parts mounting plate, rail 5 and binding components are assembled.

Figure 3A:
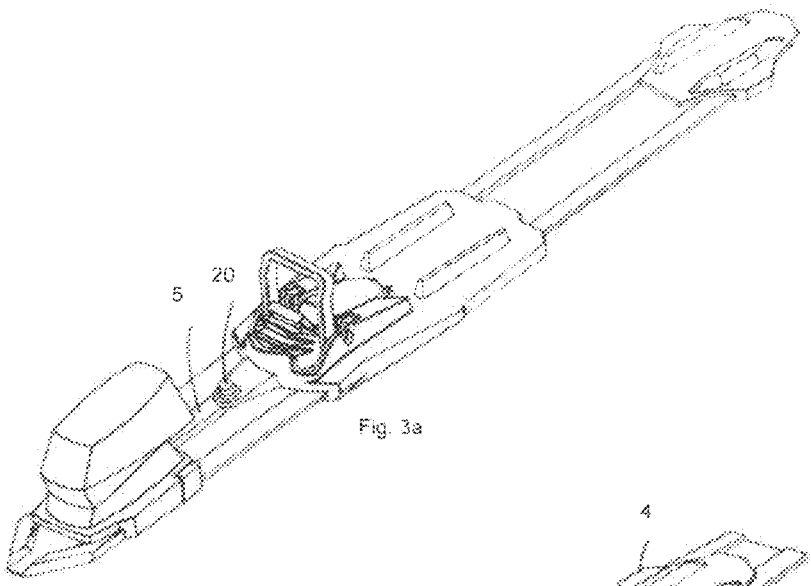
Figure 3B:
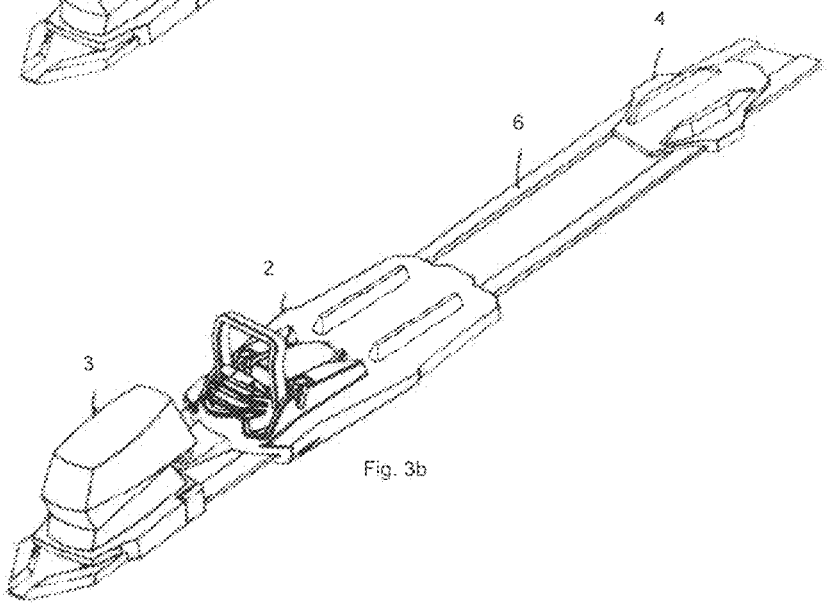

FIGS. 3*a-b* show an embodiment where a rail 5 is fastened with a pin or the like in front of the binding or binding components 2. The advantage of this embodiment is that the rail does not need to extend under the binding or binding components 2 in the channel 21 in the mounting plate 6. In this embodiment, the heel piece 4 moves together with the binding, but the heel piece may also be fixed.

Figures 4A, 4B, 4C:
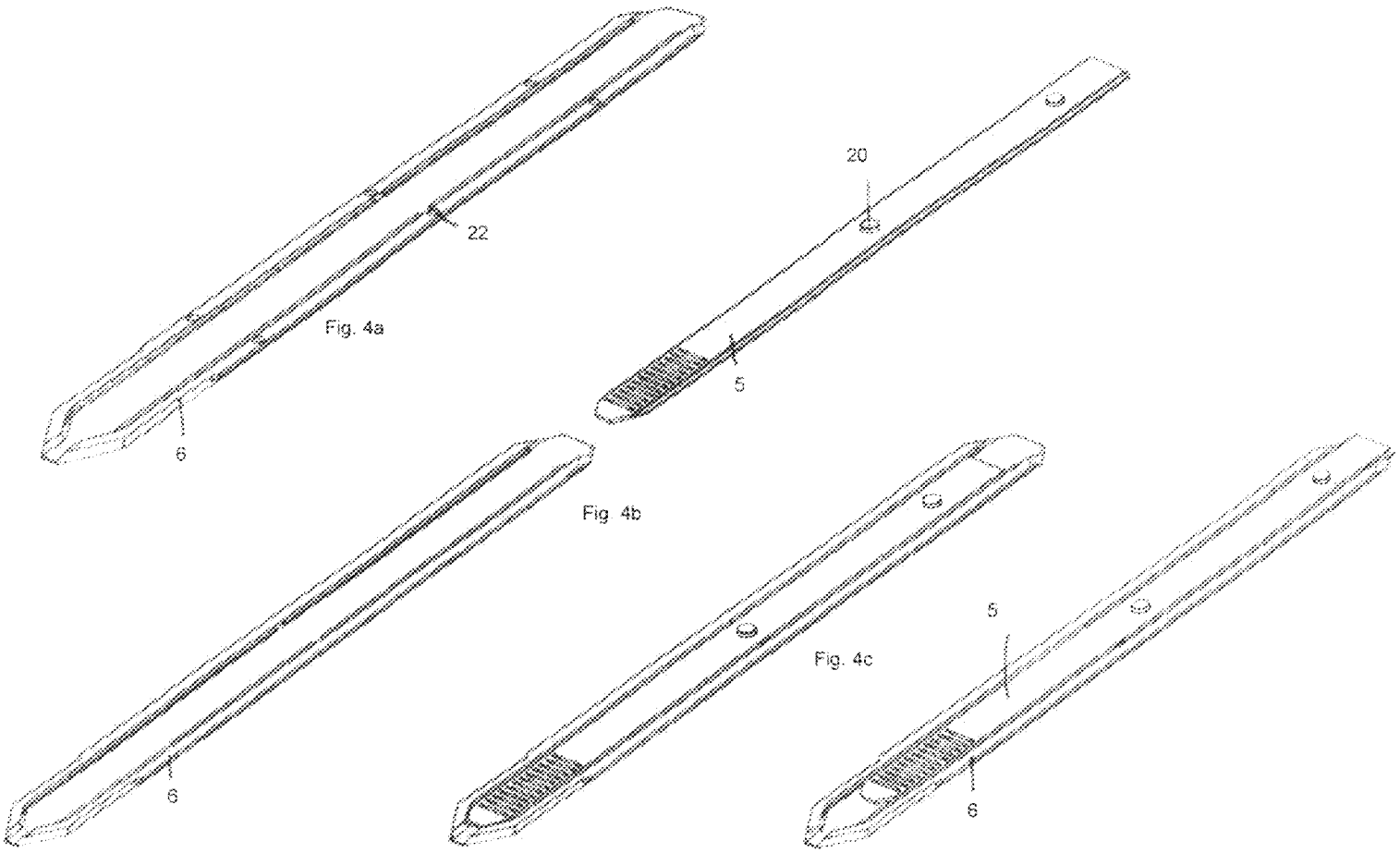

FIG. 4*a* shows a plate 6 that is fastened onto the ski with screws in screw holes 22. FIGS. b and c show an embodiment that can be glued or bonded to the ski. These embodiments also comprise pins 20 for attachment of the binding or binding components 2.

Figures 7A, 7B:
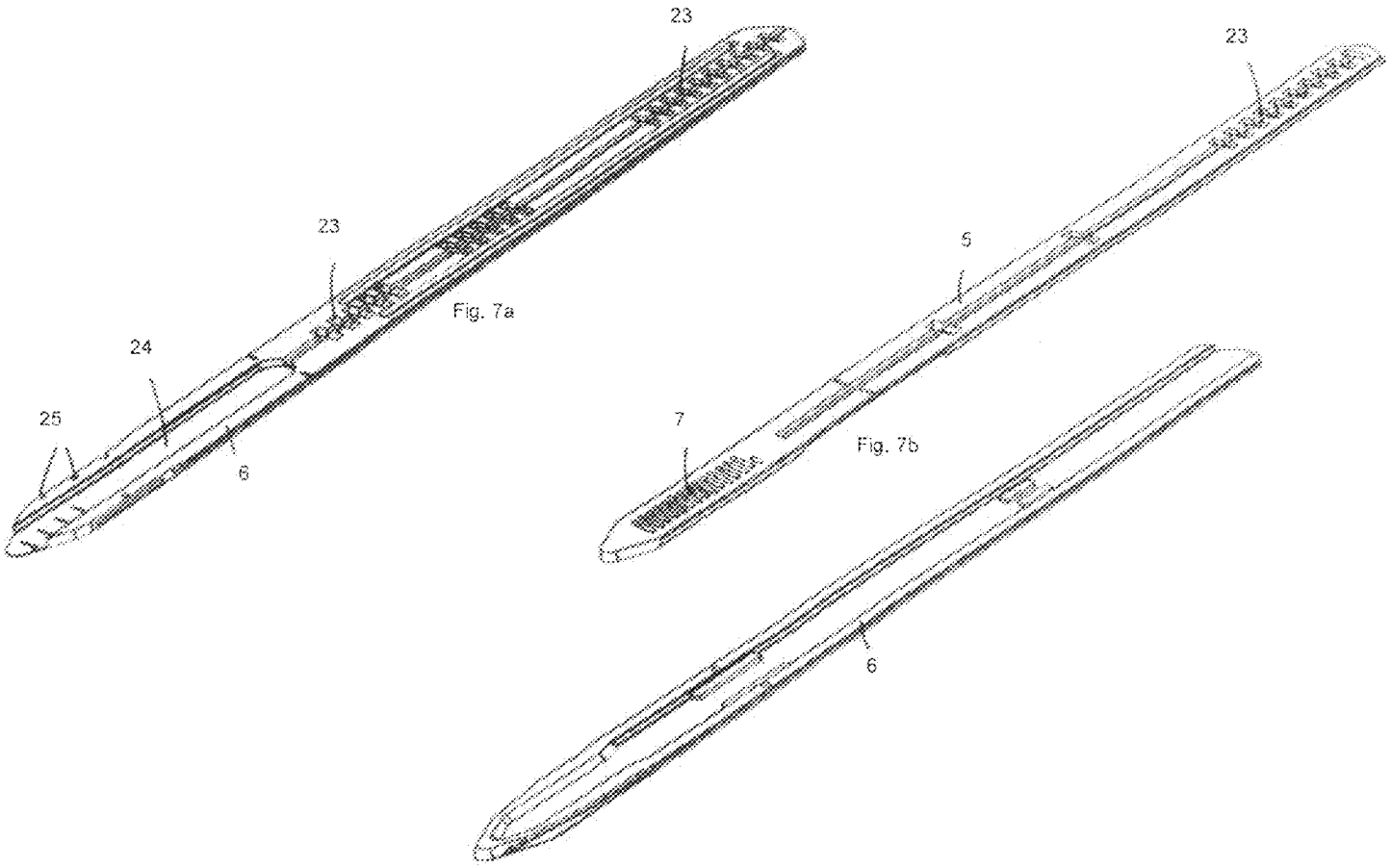

The rail 5 can, as mentioned, comprise grooves, pins and/or notches 7; 20; 23 that hold the binding or the binding components 2. If the rail comprises a long row of notches or grooves, the binding or the binding components 2 can be mounted/positioned on the rail 5/mounting plate 6 in the desired position, ref. FIG. 7*b*. FIG. 7*b* actually shows only a few notches or grooves 23 for the heel piece 4, but the same can be provided for the binding or binding components 2, where only shown two notches are now shown for a fixed position. It is possible, e.g., to provide sufficient notches/grooves to allow the binding to be mounted within a longitudinal range of 3 or 5 cm (may be more or less, it is of no significance in this example). Thus, the binding or binding components 2 are mounted/attached to the ski in the skier's neutral or desired longitudinal starting position, after which the motor 3 can move the binding or the binding components 2 back and forth as desired during skiing. Different snow conditions can also make it desirable to change the skier's neutral starting position. Such a possibility may also be useful if the skier gains or loses weight.

FIG. 7*a* shows a so-called "hybrid plate". In the mounting plate 6, a conventional binding can be attached without any dynamic system comprising a motor 3, rail 5 etc. The mounting plate 6 comprises fixed fastening notches/grooves 23. If the skier wishes to upgrade to a dynamic system, a rail can be placed in the groove 24 and a motor 3 fastened on top of the rail in fastening means 25. In this case, the binding must be of a displaceable type that does not enter into engagement with the fixed notches/grooves 23. The motor 3, rail 5 and binding or binding components 2 shown in FIGS. 3*a-b* would be suitable for aftermounting on a hybrid plate of this kind.

As an alternative to notches/grooves, the binding can also be attached/positioned/connected to the rail with the aid of snap locks, screws, hook-and-loop fastener, adhesive material etc. ref. FIG. 5*a* (hook-and-loop fastener) and FIG. 5*b*

(screws). The rail 5 and a binding can be moulded in one piece. In another embodiment, the rail 5, a binding and a motor, optionally also other elements, can form an integral unit, such that it moves in a plate 6 or in the ski.

Figures 10A, 10B:
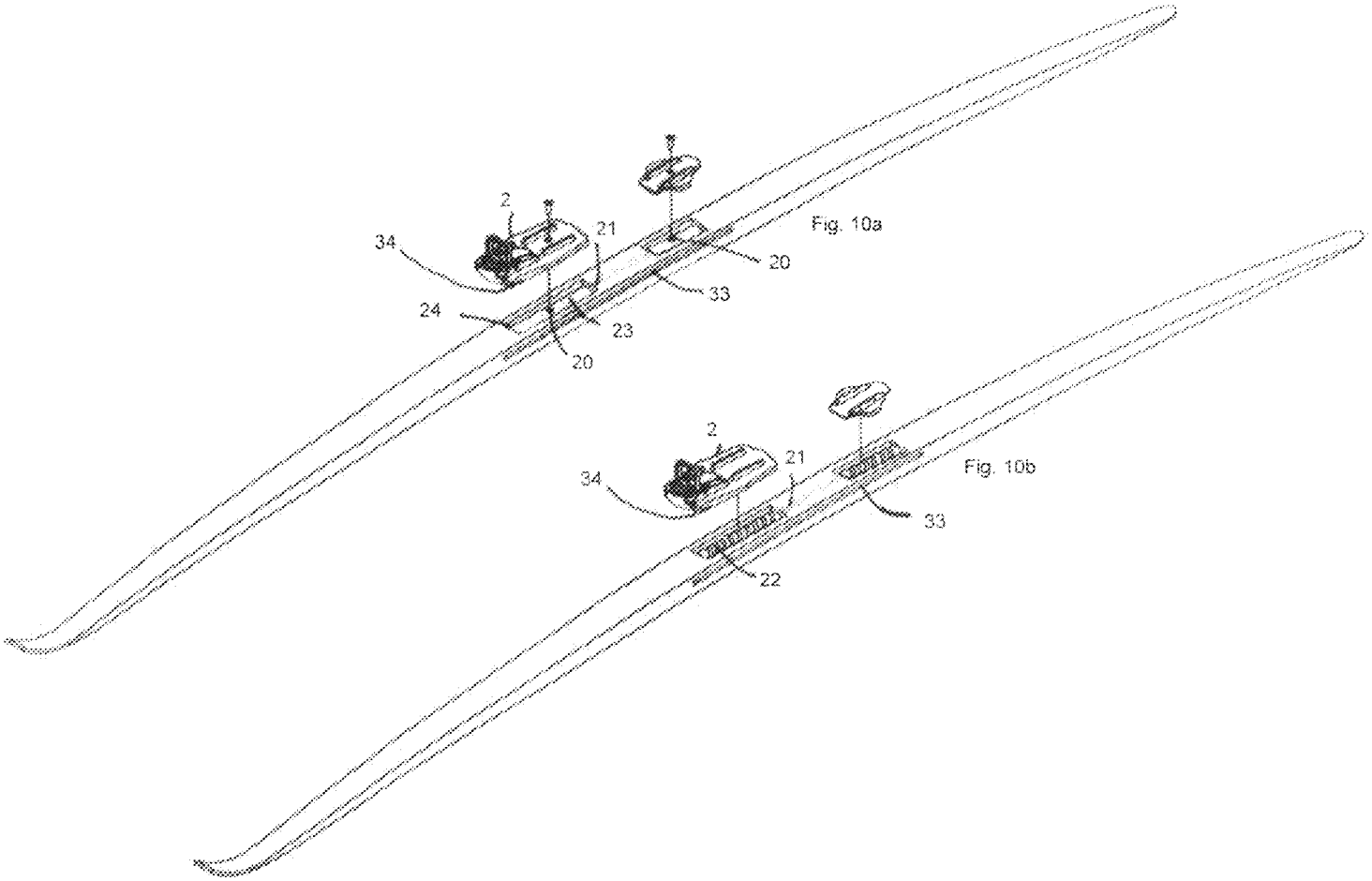
Figure 11A:
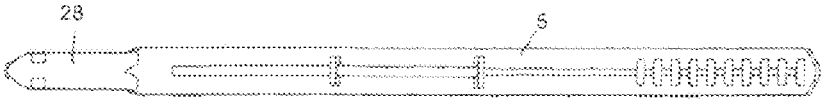
Figure 11B:
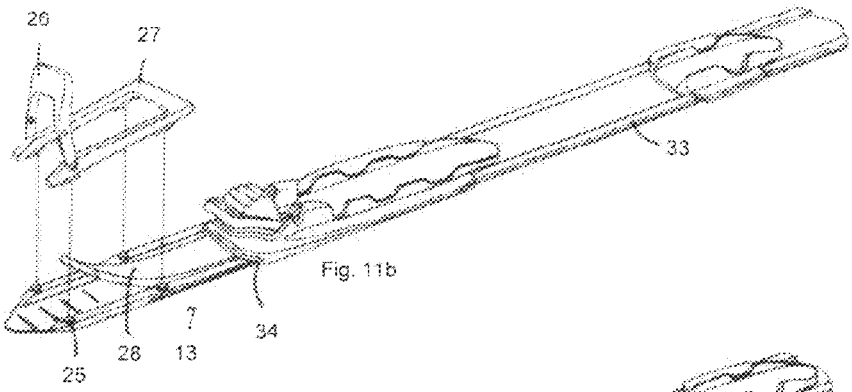
Figure 11C:
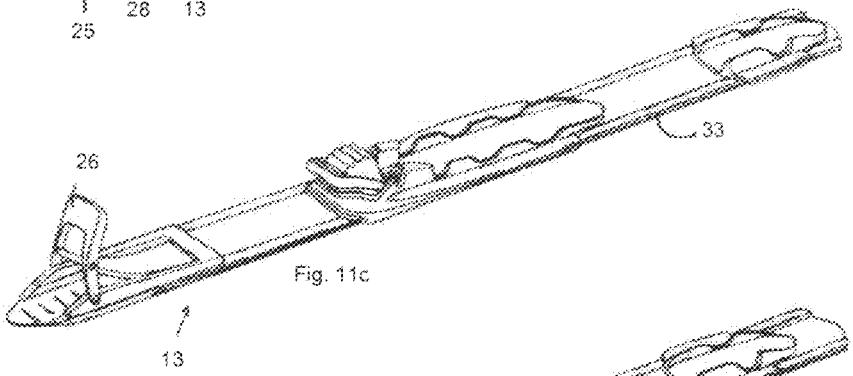
Figure 11D:
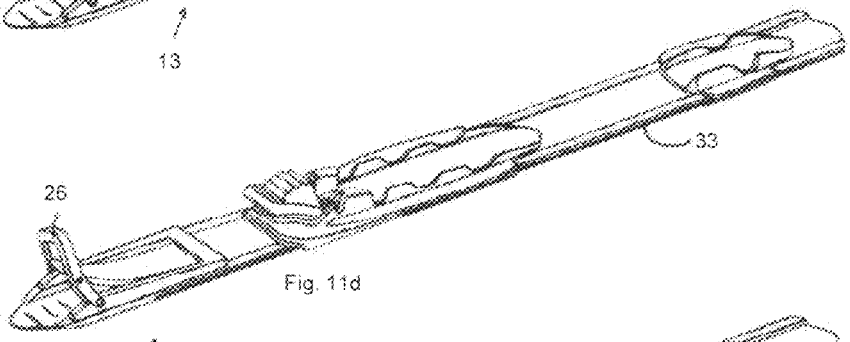
Figure 11E:
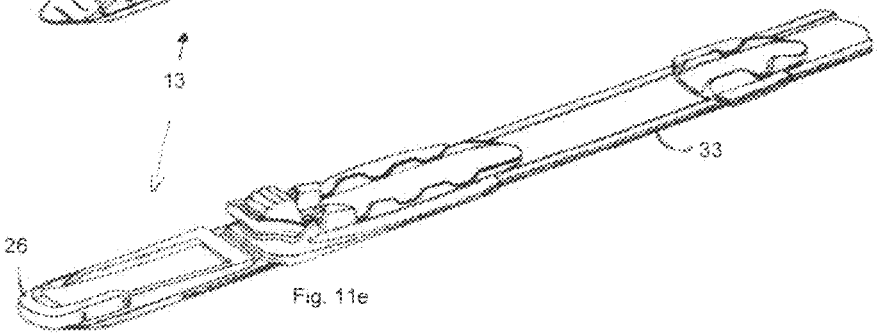

FIGS. 6*e-i* show different embodiments where the ski comprises a groove or a channel 21 able to house or accommodate an energy transfer means 22, 23. The energy transfer means 22 exhibits a worm screw capable of being turned. The energy transfer means 22 exhibits a rod in or on which the binding, or a part of the binding 2, is fastened. Here, it is fastened with the aid of a screw, but other alternatives can also be used. FIGS. 10*a-b* show a groove or a channel 21 that is wholly or partly closed. In this embodiment, the motor 3 can either be placed in the ski, on top of the ski or in the binding.

FIG. 5*d* shows moreover a rail 5 that can be pulled back and forth with the aid of a worm screw. This embodiment may be an alternative embodiment of that shown in FIGS. 1*a-c* or 6*e*.

FIGS. 10*a-b* show, as mentioned, an embodiment of the invention where a rail 5; 22; 23 or an energy transfer means runs in a groove or a channel 21 in the ski itself. In this embodiment, the ski itself functions as a mounting plate 6. The opening 24 can house the energy transfer means and other elements such as motor, control system and/or battery. FIGS. 8*a* and 8*c* show an alternative way of using the opening. Here, a mounting plate 6 is provided with an open chamber 25 that can be placed in the opening 24 or a corresponding opening. FIG. 8*c* shows a motor 3 placed in the chamber 25, where it is able to pull on a rail lying above in the mounting plate 6. FIG. 8*a* shows a plate 6 that can be glued/bonded onto the ski, FIG. 8*c* showing a plate 6 that can be screwed onto the ski. The chamber 25 can also hold elements such as control system and/or battery.

FIG. 8*b* shows an embodiment of a short plate 6, where the heel piece 4 is separate and fixed.

Figure 9A:
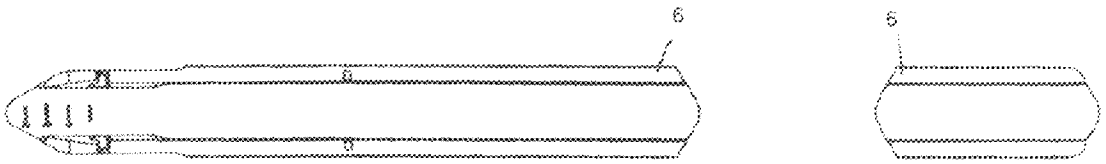

FIG. 9*a* shows an embodiment comprising two plates 6, where a heel piece is movable with a rail that extends through both plates.

Figure 9B:
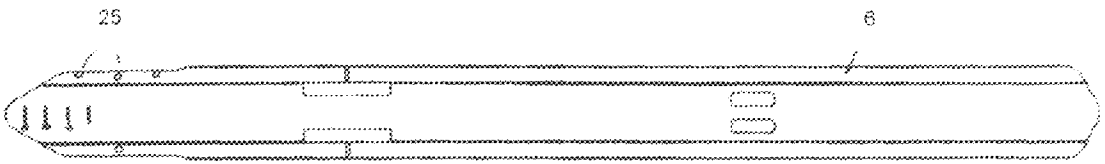

FIG. 9*b* shows standardised fastening means 25 at the front of the mounting plate 6. The advantage of these is that a motor, a battery, a closing plate etc. can all fit into the same fastening means, i.e., that they are interchangeable.

FIGS. 11*a-e*, FIGS. 17*a-e* and 18*a-c* show different manual embodiments 13 of the invention where the motor has been replaced by a manipulatable moving and locking mechanism 26, 27. Such a manual embodiment may be relevant for skiers who would like a less expensive product or who do not want the bother of advanced systems. This embodiment can also be a less expensive start package for a skier who would like the possibility of upgrading to a more advanced system at a later stage. This manipulatable moving and locking mechanism 26, 27 fits in the standardised fastening means 25. The moving mechanism may comprise a lever 26 that cooperates with a flexible tongue-like section 28 of the rail 5. By tilting the lever back and forth, the rail 5 and thus the binding, can also be moved.

In the specific embodiment shown in FIGS. 11*a-e*, the flexible tongue-like section 28 is arranged such that it bends up when the lever 26 is tilted upwards over the tilting point, and down on the other side. The point of attachment 35 of the section to the lever 26 is chosen such that the longitudinal force on the rail is sufficiently large that the rail, and thus the binding components 2, can be securely moved even though snow buildup or icing has occurred.

FIGS. 17*a-e* and 18*a-c* show an embodiment like the one shown in FIGS. 11*a-e*, where the point of attachment 35 of the tongue-like section 28 to the lever 26 also comprises transverse pins 36 that fit into suitable grooves or notches 37, 37' in the fixed part of the moving and locking mechanism 27. The point of attachment 35 of the section 28 to the lever 26 can, in an embodiment, comprise a transverse stud with ends or pins 36 that project on each side of the lever 26. These projecting pins 36 fit into complementary notches 37, 37' in the fixed part of the moving and locking mechanism 27, one pair 27 in front of the lever's 26 point of rotation 38, and one pair 27' to the rear. The advantage of this is that the energy from the skier via the rail 5 is taken up directly by the fixed part of the moving and locking mechanism 27 without being transferred via various links, The notches 37, 37' can further be configured such that the pins 36 can be snapped into the notches by means of snap locks 39, thereby ensuring the pins 36 are held in place and cannot spring up during skiing. A solution of this kind will also help to lock the lever 26 in a locked horizontal direction, so as to prevent it from swinging up in a undesirable manner during skiing. If that were to happen, the binding would "float" loosely on top of the ski, which would in every way be unfavourable and perhaps even dangerous.

FIGS. 11*a* and 16*a-d* show a separate tongue-like section 28 that is mounted on a rail 5. The section 28 may also be part of the actual rail. e.g., in that the rail is basically sufficiently flexible (ref. FIGS. 11*b-e*) or in that the rail is tapered at the front. The rail can also be provided with a transverse line of weakness that forms a bending zone or bending point. A separate section 28 can also be fastened to the rail by means of a hinged joint. FIGS. 16*a-d* show an alternative rail 5 with a section 28.

In the embodiment shown in FIGS. 16*a-d*, the rail 5 comprises two sets of five grooves 23. It should be understood that fewer or more than five grooves 23 can be used, as well as fewer or more sets of grooves. The advantage of using more grooves 23 is that the binding or binding components 2 can be pre-positioned before the binding or binding components 2 are moved/displaced dynamically whilst in motion with the aid of a motor 3, optionally with the aid of a manual system. This provides several "layers" of positioning possibilities, e.g., in connection with user/skier adaptation (weight, weight change, proficiency), snow conditions or track profile. In the last-mentioned case, it is conceivable that the track profile permits a lot of poling and little skiing in the diagonal stride technique. In such an instance, the binding or binding components 2 can be pre-positioned relatively far back so as to obtain different degrees of good glide when the position is changed dynamically whilst in motion. In the foremost dynamic position, it will be possible to have relatively good grip in a short steep hill. Conversely, if the track profile has many upward slopes and thus requires a great deal of skiing in the diagonal stride technique, the binding or binding components 2 can be pre-positioned relatively far forwards thereby obtaining different degrees of good grip when the position is changed dynamically whilst in motion. In the rearmost dynamic position, it will be possible to have relatively good glide on flatter terrain.

FIGS. 11*a-e* show a rail 5 with one set of one groove 23. It will be understood that this rail can instead comprise a rail 5 of the type shown in FIGS. 16*a-d*, i.e., having more grooves 23 in order to allow the aforementioned pre-positioning. The same applies to all the other illustrated embodiments comprising one or more sets of one groove 23.

Figure 12:
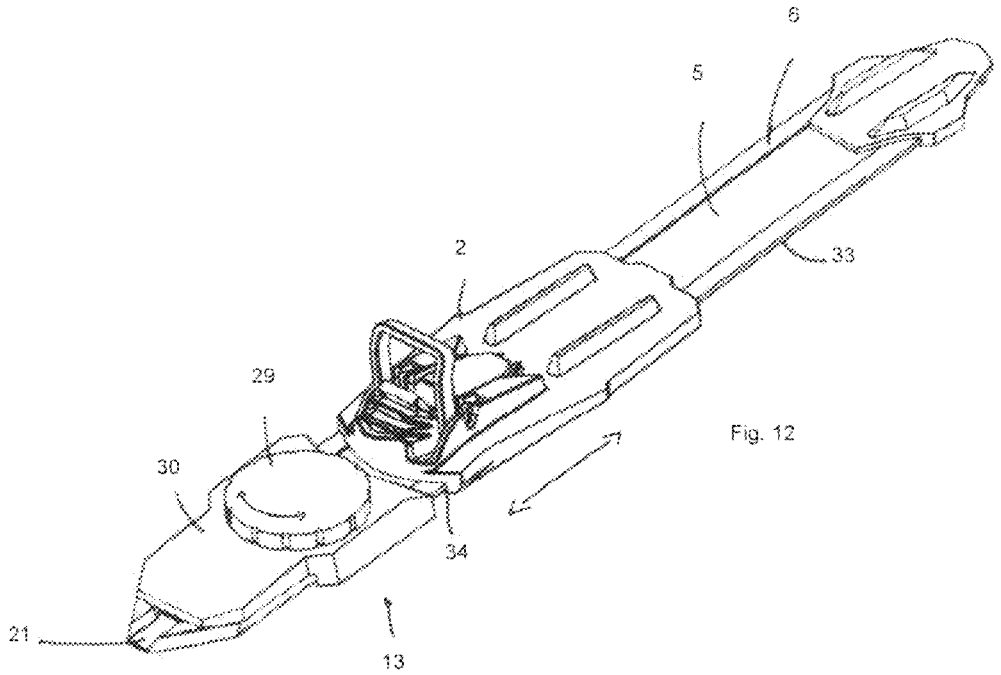
FIG. 12 shows a second manual embodiment of the present invention.

FIG. 12 shows an alternative manual embodiment 13 comprising a rotary wheel 29 that moves the binding or binding components 2 back and forth. The housing 30 fits and is fixed in the standardised fastening means 25. The rotary wheel 29 may comprise toothed wheels or cams (not shown) that pull the rail back and forth. The rotary wheel 29, the toothed wheel(s) and/or cam(s) are fixed relative to the ski in the standardised fastening means 25.

Figure 13:
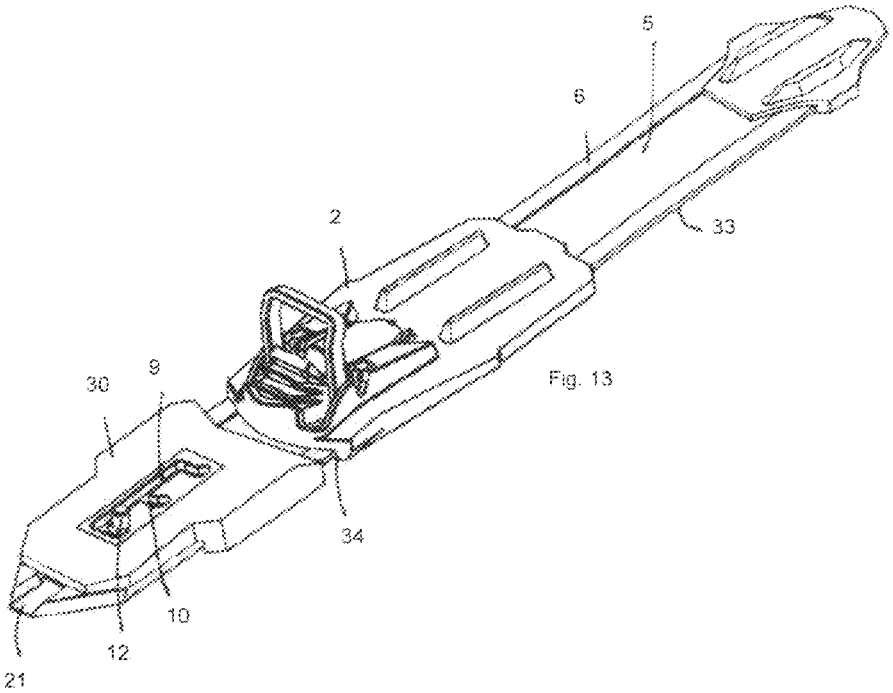
FIG. 13 shows a third manual embodiment of the present invention.

FIG. 13 shows a further alternative embodiment comprising a longitudinal groove 9 and a plurality of transverse grooves 10 that are arranged in a housing 30. The housing 30 is fixedly mounted relative to the ski in the standardised fastening means 25. A lever 12 is mounted in connection with the rail 5 such that the lever 12 can be moved from one transverse groove to another. The distance between grooves 10 determines the distance between the different positions of the binding 2. An overcentre mechanism, screw button or laterally arranged lever etc. is also conceivable.

Figure 14:
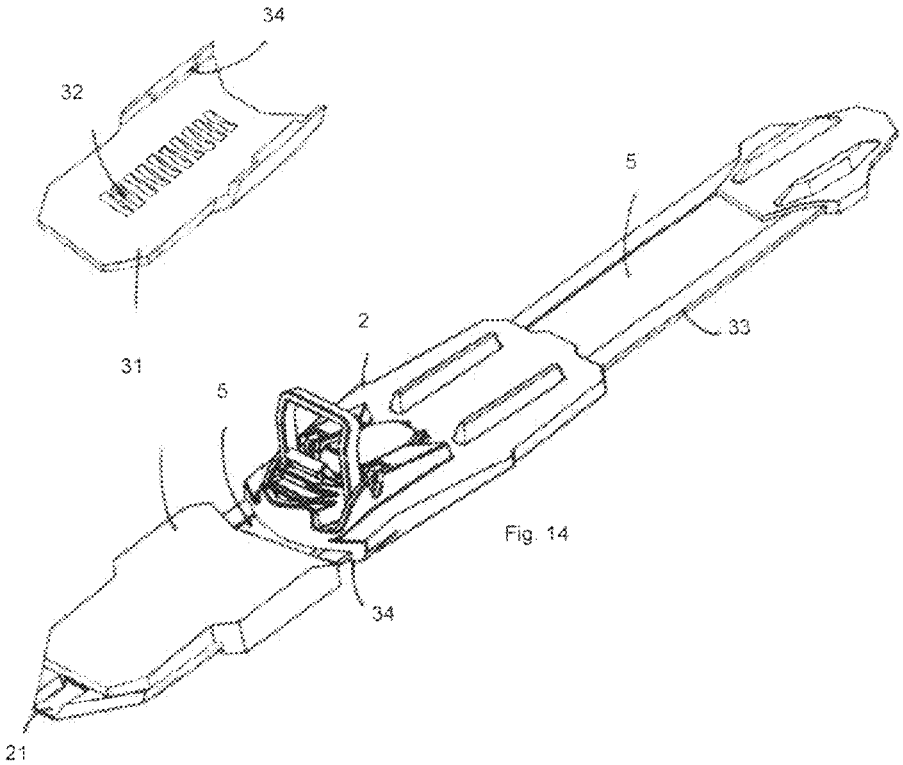
FIG. 14 shows a fourth embodiment of the present invention.
Figure 15A:
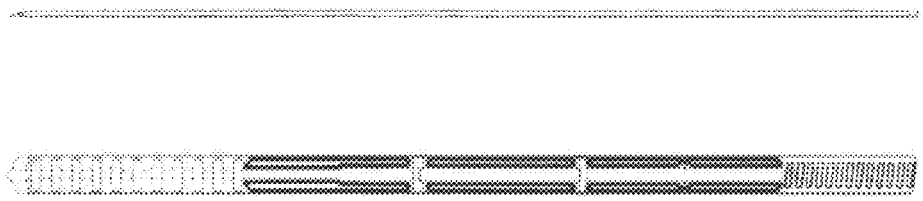
Figure 15B:
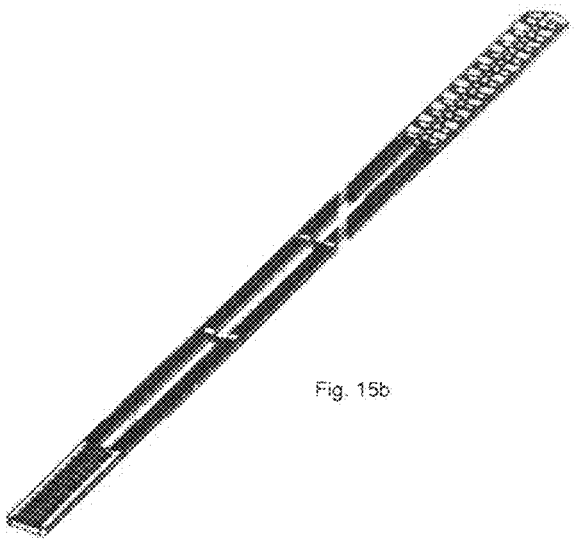
Figure 15C:
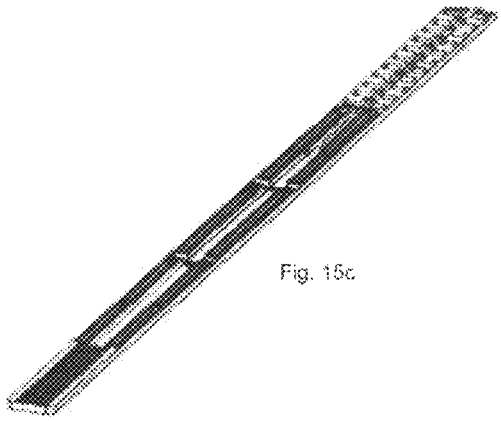
Figure 15D:
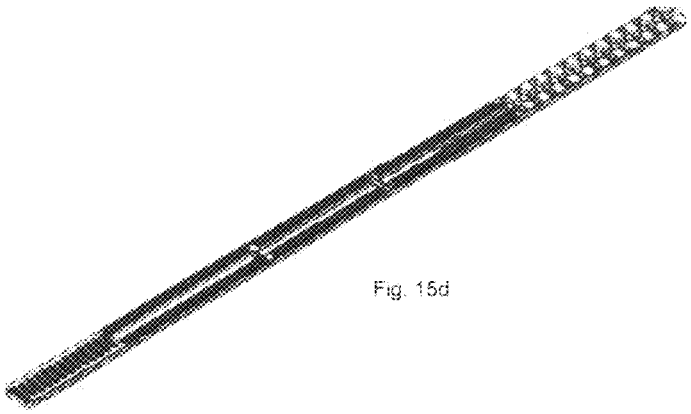
Figure 16A:
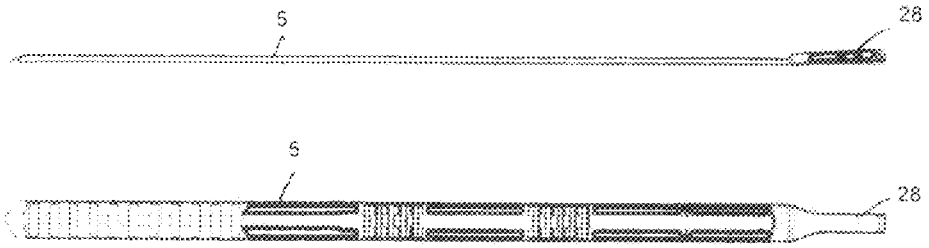
Figure 16B:
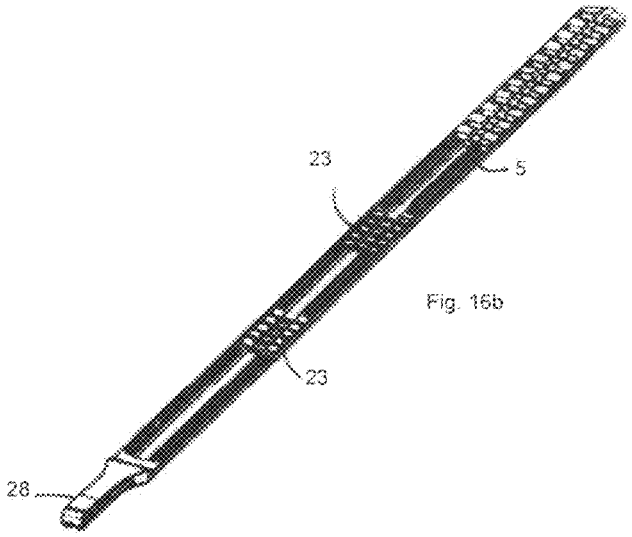
Figure 16C:
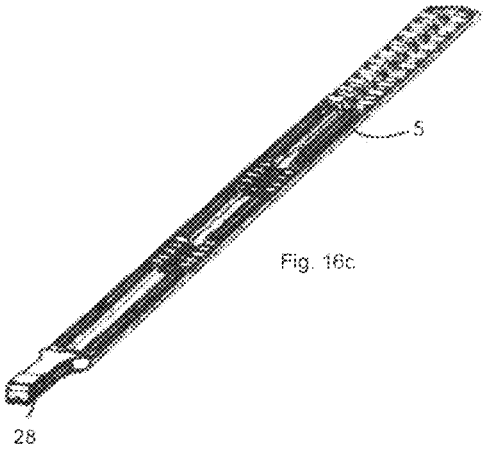
Figure 16D:
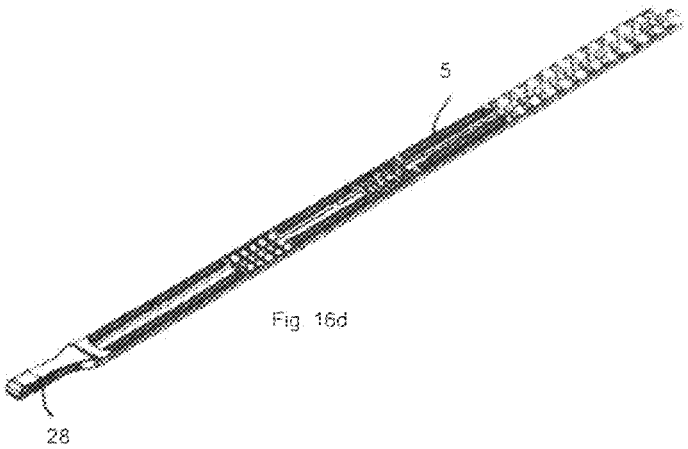
Figure 17A:
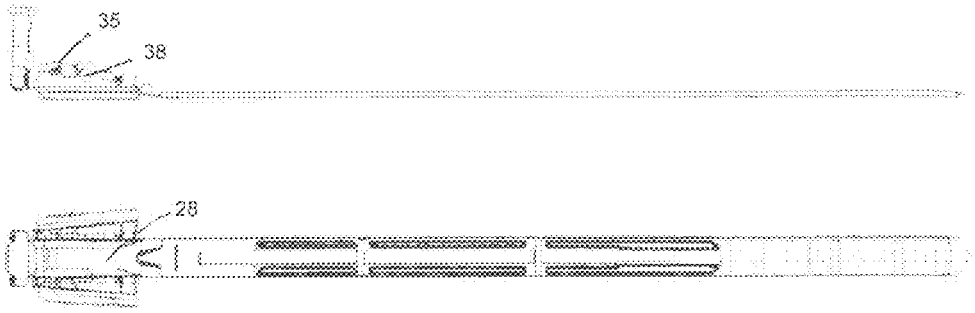
Figure 17B:
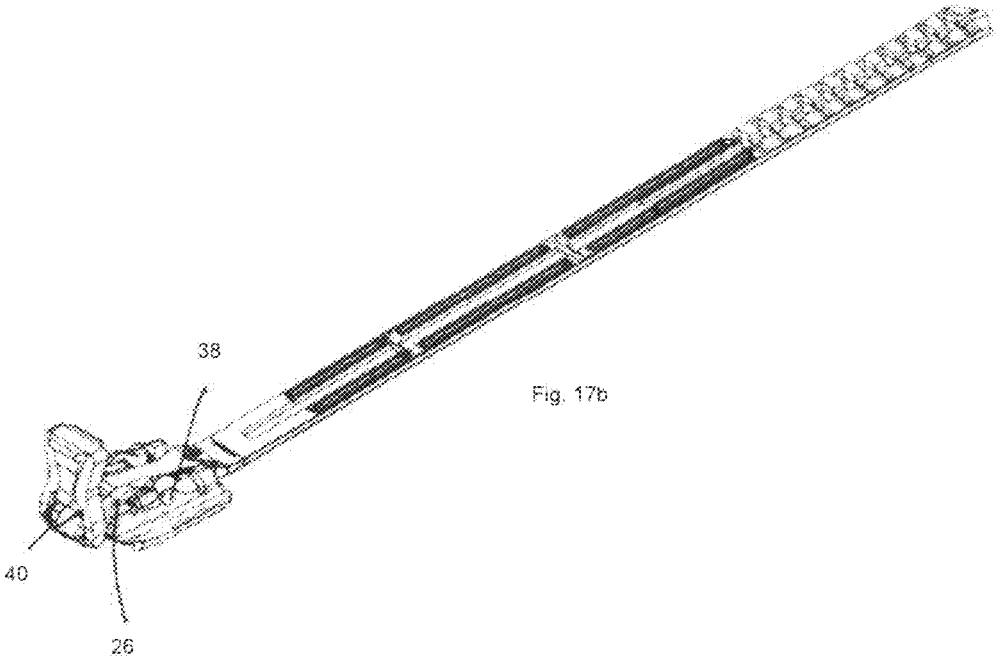
Figure 17C:
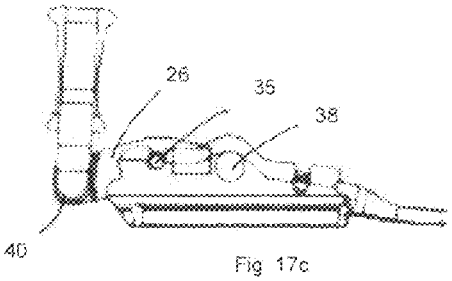
Figure 17D:
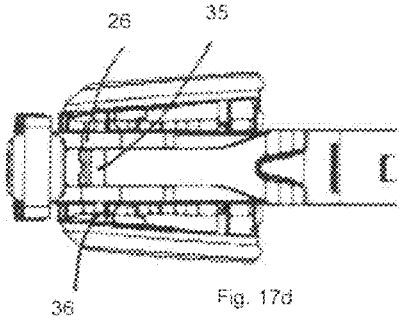
Figure 17E:
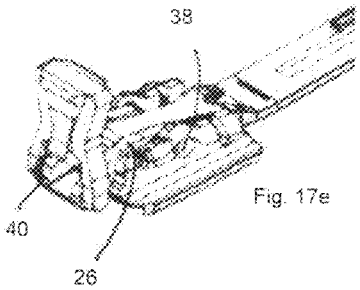

FIG. 14 shows a locking plate or a locking housing 31. This can be configured such that it fits in the standardised fastening means 25. The grooves or notches 31 are configured so as to engage with corresponding grooves/notches 7 in the rail 5 so as thereby to lock the binding or binding components 2 fixed in one position. This position can per se be altered by removing the plate 31, adjusting the position of the rail 5/binding or binding components 2, and then replacing the plate 31. A single plate 31 of this kind can be a temporary solution or sold as a future-compatible system that can be upgraded with a manual or dynamic embodiment.

The embodiment shown in FIG. 14 shows the mounting plate 6, the rail 5 and the binding components 2 as a three-part unit in which no reciprocal movement is allowed. In this embodiment, the rail 5 is locked to the mounting plate 6 in the longitudinal direction, and the binding components grip around the mounting plate and the rail such that the three parts form an interlocked three-part unit which cannot be moved in any direction, in this case with the aid of the locking plate 31. FIG. 14 shows a locking plate 31 that is arranged at the front, but it will be understood that it can be arranged at a point in the middle of or behind the mounting plate system. The locking devices between the mounting plate 6 and the rail 5 and between the rail 5 and the binding components 2 prevent longitudinal movement of the unit, whilst the binding components that grip around the mounting plate and the rail prevent movement in all other directions. FIG. 14 shows use of a locking plate 31, but the rail can also be secured in the longitudinal direction with the aid of other locking devices. An embodiment of such alternative locking devices can comprise locking devices between the rail 5 and the mounting plate 6, either an intermeshing solution (i.e., a form of direct interlocking) or one or more intermediate, separate locking devices. In both the last-mentioned cases, the locking devices between the rail 5 and the mounting plate 6 can be located underneath the rail 5 or around the edge of the rail 5.

An embodiment of direct interlocking is shown in FIG. 19. In the illustrated embodiment, the rail 5 comprises "wings" 41 that fit into complementary pockets 42 in the mounting plate 6. The mounting plate 6 can comprise a plurality of pockets, so that the longitudinal position of the rail 5 can be adjusted. In addition, there may be a number of grooves 23 or similar locking means on top of the rail 5 for additional possible positioning. In an embodiment, the rail 5 shown in FIG. 19 can be reversed or turned, both transversely and longitudinally. Turning it upside down will give different interfaces above and below the rail 5, such that different types of bindings, e.g., from different manufacturers can be mounted. A similar possibility may conceivably be obtained by turning the rail in the longitudinal direction, in addition to being able to obtain an adjustment of position in the longitudinal direction: Instead of wings/pockets, similar solutions are possible. e.g., complementary undercuts/grooves, complementary notches, snap locks, swivel locks etc.

FIGS. 20*a-c* show how interface can be varied and adapted to different use and/or different binding systems. The illustrated rail 5 is a manual embodiment, but it will be understood that it could just as easily be a dynamic or fixed embodiment.

The aforementioned manual embodiment can also be used as a handy spare part that can be taken along during use. If the skier should run into problems with an electric motor, e.g., in that it runs out of battery, is damaged or starts to run sluggishly, the motor 3 can easily be changed and replaced with the manual embodiment as it has the standardised fastening means 25. The standardised fastening means 25 can be used by both manual and dynamic/electric elements, such that everything can be interchangeable.

The manual embodiments will per se not allow the dynamic positioning/gearing that has been referred to above, but will allow future upgrading to a dynamic system or be a temporary alternative. In certain cases, the skier may wish to use a manual system, e.g., during expeditions or on longer trips without access to electricity. The system can thus be modular.

The positions or the positioning of the binding or binding components 2 mentioned above can be discrete or continuous.

If the system is electric and makes use of electrical signals, these signals can be given or sent from buttons, levers, switches, sensitive zones or similar means, which, for example, can be arranged on a glove or ski pole. Such means could then be said to constitute control or operating means. Other locations and actuating methods are also conceivable. For example, there could be three buttons, "forwards/good grip", "neutral/standard" and "backwards/good glide". The system could also be stepless.

In addition, there could be a separate position for fastening the ski shoe to the binding/ski. It is, e.g., conceivable that in addition to a forward, centre and rear position, there is a "fourth position" that opens the binding. In this fourth position, the binding can be open and the skier can put on or take off the ski. If the skier wishes to put the ski on, the binding can be locked by being moved to the forward, middle or rear position (there could of course be more positions). Alternatively, the binding could be locked electrically in the fourth position. This aspect can also be combined with a step-in solution, where the skier can step into the binding in any position, but must move the binding to the fourth position for the step-in binding to open. In any case, it is possible to provide a manual open/close system that allows opening in emergencies or in a simpler version of the system.

Although an electric motor 3 is described, a pneumatic system, hydraulic system, mechanical system etc. that is capable of pushing the binding or the binding components 2 back and forth between different longitudinal positions can also be used. Such alternative systems can be electrically actuatable.

If an electric motor 3 is used, the system must comprise an energy source 7 in the form of an energy storage element (battery, capacitor, spring/dynamo etc.) This or these may be arranged in connection with the motor 3, at another point on the binding or the ski, in the shoe or at a point on the skier's body. Furthermore, the system may comprise a signal transponder or other communication means/microprocessor that receives a signal, processes it and sends a signal on to the motor 3 causing it to push the binding back and forth.

The motor, the manual embodiment or the locked embodiment can be attached to the ski/plate in different ways. The fact that they are lockably connected results in the advantages mentioned above, i.e., that the skier has the option of changing or upgrading sub-elements. This applies not only to the motor, the manual embodiment or the locked embodiment, but also to the rail, binding, battery etc.

Since the forces transferred from the skier via the binding to the ski will be large, the system may comprise elements that lock the binding in the selected position after the motor 3 has displaced the binding (only shown for the manual system). The locking element should in that case be of such a kind that it withstands strong applied forces. Instead of separate locking elements, the locking element may be a part of the electric motor 3 or a pneumatic system, hydraulic system, mechanical system etc.

In an embodiment, the locking element may be arranged in connection with the electromotor, e.g., in that a rotating shaft from a motor, optionally via a gearing, is locked in the axial direction. The shaft can thus rotate freely whilst axial forces that are transferred from the binding to the shaft are taken up by the locking element. If the shaft from the electromotor transfers rotational forces via a simple gear system to another shaft, the shaft from the electromotor will in any case not be affected by any axial play or migration that may arise, either through necessary tolerances or wear in the locking element.

One or more sensors, in or in connection with a electric actuator, the motor 3 or pneumatic system, hydraulic system, mechanical system etc. can optionally sense and send a signal back to the transponder/microprocessor with information on the position and state of the binding.

It will be understood that the system according to the electric version of the present invention in most cases should be sealed or protected from water ingress. Ingress of snow, ice and condensation can also pose a problem against which the system can or should be protected. To mitigate condensation problems, heating elements can be arranged on the inside of the wholly or partly sealed chambers, e.g., in the form of electric resistance/heat wires that emit sufficient heat to cause the condensation to evaporate and penetrate out of the system. One or more of the elements in the system, e.g., the biased spring or springs can per se form such electric resistance/heat wires. Such a drying process can be initiated automatically or manually in connection with charging the power source, i.e., preferably a battery. Alternatively, condensation problems can be mitigated by providing suitable air vents or the like. These can be arranged such that condensation escapes whist snow and ice are not admitted.

An advantageous aspect of the present invention is that all the elements, including electromotor, binding, plate/interface (interface usually designates the interface between plate and binding. Different types of bindings and/or binding manufacturers can have different interface), transfer element, fastening means on the shoe/sole etc., can be made independent of one another, i.e., that each element can be improved and changed individually without other elements necessarily being affected or having to be changed.

Thus, each element can also be manufactured as "off-the-shelf items" that can be used for different norms, systems and areas of utilisation (professional, performance, touring, back-country etc.).

The plate can per se be replaceable. Different types of bindings can be configured to fit the plate. The transfer means can fit different types of bindings at one end, whilst it fits different types of electromotor at the other end.

In the above examples and embodiments, a binding system is described that is adjusted as desired by the skier, that is to say, that the skier himself decides what position the binding should have on the ski by sending a signal to the binding system, for example, by pressing on buttons or the like on his glove or ski pole. A fully or semi-automatic system is also conceivable where different sensors in the binding system gather relevant information, such as speed, angles, acceleration, application of force etc. for calculating what the optimal position for the binding is, after which movement of the binding takes place automatically. Such a system can be overridden by manual buttons if the skier is not satisfied with the position of the binding.

The examples above show that the binding or binding components 2 are moved as a whole. Individual elements of the binding, e.g., flexor(s), gripping mechanism or other parts can also be moved independent of each other or some elements, but not all. Then a part of the binding will remain fixed whilst other parts are moved.

Default mode can be said to be a neutral setting that represents a compromise between all actuatable positions and settings. In the first instance, default mode can be thought of as corresponding to the positions and settings that a conventional ski/binding/shoe will assume/have without the possibility of adjustment. The system can go into default mode when a battery level is low, ski poles break, the control unit(s) cease to work, one or more functions or parts of the system stop functioning as intended because of electrical, mechanical, control, temperature, moisture or other relevant factors or conditions.

According to one embodiment of the invention, default mode can be selected in advance, such that certain properties are accorded importance when or if a battery level is low, ski poles break, the control unit(s) cease to function etc.

If the operating controls are located on the ski poles, it may be decided to have a redundant system where both poles or both gloves comprise operating controls. The operating controls on both ski poles will then be able to control the system. If one of the poles breaks, the other pole with operating controls will then control the system. Similarly, if something should happen to one of the gloves, the system will still be operable. If both poles should break, or both gloves should be damaged or lost, the system will go into default mode, either factory-defined or pre-determined by the skier or service crew, optionally the system can be controlled externally by the service crew or trainer.

As an alternative to changing the position of a binding on a ski, one or more of the elements in the system described above can also be used to alter the properties of the ski in such a way that the net effect will be the same or similar. The purpose of changing the binding position is to make use of changes in the ski camber to achieve a gear effect. Such a gear effect can also be obtained by changing the properties of the ski directly. This can be achieved in that a motor, an energy transfer means, a power source and a control system are used to regulate the rigidity of the whole or parts of the ski, move the ski camber and/or wax pocket, change the configuration of the wax pocket. The properties of the ski can also be changed in other ways, e.g., in that a voltage or current changes the material properties (rigidity/surface/spring-constant etc.) of the ski.

The invention thus relates to a mounting system for a binding or a binding component 2; 4 on a cross-country ski, where a mounting plate 6 is arranged on a top surface of the ski and where the mounting plate 6 comprises longitudinal side edges that have a profile 33 with undercuts for longitudinal positioning and attachment of the binding, or the binding component 2; 4 with the aid of a complementary profile 34 on the binding or the binding components 2; 4.

An aspect of the invention is that the mounting plate 6 comprises a longitudinal channel 21 that houses a longitudinal rail 5, where the upper side of the rail 5 comprises at least one locking device 20; 23, and where the underside of the binding or binding components 2; 4 comprises at least one complementary locking device.

A second aspect of the invention is that the locking device on the rail and the complementary locking device on the binding or binding component 2; 4 are designed to lock together whilst the complementary profile on the binding or binding component 2; 4 grips around the profile with undercuts on the mounting plate.

A further aspect of the invention is that the rail 5 is designed to slide longitudinally back and forth in the channel 21.

A further aspect of the invention is that the rail 5 is designed to slide longitudinally back and forth in the channel 21 with the aid of a motor 3.

A further aspect of the invention is that the rail 5 constitutes an energy transfer means between a motor 3 and the binding or binding component 2.

A further aspect of the invention is that the rail 5 comprises grooves, ridges, bosses, arms or holes 7; 20; 23 on the upper side, the underside, the edges or combinations thereof, where the grooves, ridges, bosses, arms or holes form energy transfer means that directly or indirectly receive energy from the motor.

A further aspect of the invention is that the rail 5 is designed to sit firmly in the channel.

A further aspect of the invention is that the rail 5 comprises locking devices on the underside or around the edge that cooperates with complementary locking devices in the mounting plate.

A further aspect of the invention is that the rail 5 in front comprises a flexible tongue-like section 28 that is designed to cooperate with a moving and locking mechanism 27, which moving and locking mechanism 27 comprises a fixed part 41 and a rotatable lever 26, the fixed part 41 being fixedly mounted relative to the ski, where the flexible tongue-like section 28 is fastened to the lever 26 at a point of attachment 35 that is located between the centre of rotation of the lever 26 and the outer end 40 of the lever's 26 manipulatable part, the lever 26 forming an overcentre mechanism that is designed to move the point of attachment 35, and thus the rail 5, back and forth in the longitudinal direction in the channel 21.

A further aspect of the invention is that between the lever's 26 centre of rotation 38 and the outer end 40 of the lever's manipulatable part there are further provided transverse pins 36 that fit into separate grooves or notches 37; 37' in the first part 41 of the moving and locking mechanism 27.

A further aspect of the invention is that the grooves or notches 37; 37' in the fixed part 41 comprise snap locks 39.

The invention claimed is:

1. A mounting system for a binding or a binding component on a cross-country ski, the mounting system comprising:

a mounting plate on a top surface of the cross-country ski, the mounting plate including longitudinal side edges having a profile with undercuts for longitudinal positioning and attachment of the binding or binding component with an aid of a complementary profile on the binding or binding component, and a longitudinal channel that houses a longitudinal rail, wherein an upper side of the longitudinal rail includes at least one locking device, wherein an underside of the binding or binding component includes at least one complementary locking device, wherein the longitudinal rail extends to a forward part of the binding or binding component, wherein the longitudinal rail and the binding or binding component are arranged in series.

2. The mounting system according to claim 1, wherein a heel piece is fastened to the binding or binding component via a separate additional rail, such that the heel piece is configured to move together with the binding or binding component via the separate additional rail, and the longitudinal rail, the binding or binding component, the separate additional rail, and the heel piece are arranged in series.

3. The mounting system according to claim 1, wherein the longitudinal rail is configured to slide longitudinally back and forth in the longitudinal channel.

4. The mounting system according to claim 1, wherein the longitudinal rail is configured to slide longitudinally back and forth in the longitudinal channel based on operation of a motor.

5. The mounting system according to claim 4, wherein the longitudinal rail comprises grooves, ridges, bosses, arms or holes on the upper side of the longitudinal rail, an underside of the longitudinal rail, edges of the longitudinal rail, or combinations thereof, where the grooves, ridges, bosses, arms or holes are configured to directly or indirectly receive energy from the motor.

6. The mounting system according to claim 1, wherein the longitudinal rail is configured to transfer energy between a motor and the binding or binding component.

7. The mounting system according to claim 1, wherein the longitudinal rail comprises a locking device on an underside of the longitudinal rail or around an edge of the longitudinal rail that is configured to cooperate with complementary locking devices in the mounting plate.

8. The mounting system according to claim 1, wherein the longitudinal rail, at a front of the longitudinal rail, comprises a flexible tongue-like section that is configured to cooperate with a moving and locking mechanism, the moving and locking mechanism comprises a fixed part and a rotatable lever, the fixed part being fixedly mounted in relation to the cross-country ski, the flexible tongue-like section is fastened to the rotatable lever at a point of attachment located between a center of rotation of the rotatable lever and an outer end of a manipulatable part of the rotatable lever, the rotatable lever forms an overcenter mechanism that is configured to move the point of attachment back and forth in a longitudinal direction in the longitudinal channel, to move the longitudinal rail back and forth in the longitudinal direction in the longitudinal channel.

9. The mounting system according to claim 8, wherein the point of attachment includes projecting transverse pins that fit into separate grooves or notches in the fixed part of the moving and locking mechanism.

10. The mounting system according to claim 9, wherein the separate grooves or notches in the fixed part of the moving and locking mechanism includes snap locks.

* * * * *